US011808037B2

(12) United States Patent
Oleske et al.

(10) Patent No.: US 11,808,037 B2
(45) Date of Patent: Nov. 7, 2023

(54) HIGH SOUND ATTENUATION BUILDING PANELS

(71) Applicant: ARMSTRONG WORLD INDUSTRIES, INC., Lancaster, PA (US)

(72) Inventors: Peter J Oleske, Lancaster, PA (US); Robert C. Garman, Millersville, PA (US); Jacob D. Peterson, Lancaster, PA (US); Stephen G. Mearig, Lititz, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 17/899,268

(22) Filed: Aug. 30, 2022

(65) Prior Publication Data

US 2022/0412083 A1 Dec. 29, 2022

Related U.S. Application Data

(63) Continuation of application No. 16/447,621, filed on Jun. 20, 2019, now Pat. No. 11,459,752.

(60) Provisional application No. 62/692,995, filed on Jul. 2, 2018.

(51) Int. Cl.

| | |
|---|---|
| ***E04B 9/00*** | (2006.01) |
| ***E04B 1/86*** | (2006.01) |
| ***E04B 1/84*** | (2006.01) |

(52) U.S. Cl.

CPC ..... *E04B 9/001* (2013.01); *E04B 1/86* (2013.01); *E04B 2001/8461* (2013.01)

(58) Field of Classification Search

CPC ..... E04B 9/001; E04B 1/86; E04B 2001/8461

See application file for complete search history.

(56) References Cited

U.S. PATENT DOCUMENTS

| | | | | |
|---|---|---|---|---|
| 4,719,730 | A * | 1/1988 | Winkowski | E04B 2/7411 52/489.1 |
| 5,071,511 | A | 12/1991 | Pittman | |
| 5,558,710 | A | 9/1996 | Baig | |
| 5,905,234 | A | 5/1999 | Tsukamoto | |
| 5,911,818 | A | 6/1999 | Baig | |
| 5,923,002 | A * | 7/1999 | McGrath | E04B 1/82 181/290 |
| 5,964,934 | A | 10/1999 | Englert | |
| 6,443,256 | B1 | 9/2002 | Baig | |
| 6,855,753 | B1 | 2/2005 | Englert | |
| 7,798,287 | B1 | 9/2010 | Surace | |
| 7,862,687 | B2 | 1/2011 | Englert | |

(Continued)

FOREIGN PATENT DOCUMENTS

| | | |
|---|---|---|
| EP | 1391443 A2 | 2/2004 |

*Primary Examiner* — Forrest M Phillips

(74) *Attorney, Agent, or Firm* — Patrick Sheldrake

(57) ABSTRACT

Described herein is an acoustic ceiling panel comprising: a first air-permeable body comprising a first major surface opposite a second major surface and a side surface extending between the first and second major surfaces, the first body having an NRC value of at least 0.5 as measured between the first and second major surfaces of the first body; and an attenuation coating applied to the second major surface of the body and the side surface of the body, whereby the attenuation coating seals at least a portion of the second major surface and the side surface of the body.

21 Claims, 15 Drawing Sheets

(56) References Cited

U.S. PATENT DOCUMENTS

| | | | | |
|---|---|---|---|---|
| 8,182,922 | B2 | 5/2012 | Baig | |
| 9,702,142 | B1 | 7/2017 | Wang | |
| 2004/0209071 | A1 | 10/2004 | Carbo | |
| 2009/0194365 | A1* | 8/2009 | Johnson | E04B 2/7412 181/290 |
| 2014/0202788 | A1 | 7/2014 | Hansen | |
| 2014/0262603 | A1* | 9/2014 | Johnson | E01F 8/0017 181/211 |
| 2016/0230395 | A1 | 8/2016 | Cusa | |
| 2016/0230384 | A1 | 12/2016 | Blades | |

* cited by examiner

HIGH SOUND ATTENUATION BUILDING PANELS

CROSS-REFERENCE TO RELATED APPLICATIONS

This application is a continuation of U.S. application Ser. No. 16/447,621, filed on Jun. 20, 2019, which claims the benefit of U.S. Provisional Application No. 62/692,995, filed on Jul. 2, 2018. The disclosure of the above application is incorporated herein by reference.

FIELD OF INVENTION

Embodiments of the present invention relate to acoustic building panels having noise reducing and high sound attenuation characteristics.

BACKGROUND

Various types of ceiling systems have been used in commercial and residential building construction to provide the desired acoustical performance. Noise blocking between rooms is required for a variety of purposes, including speech privacy as well as not bothering the occupants of adjacent rooms. Sound dampening within a single room is also required for a variety of purposes, including decreasing volume levels within a single space.

Previous attempts have been made to improve noise blocking between adjacent rooms. However, such previous attempts either lack noise reducing performance or are limited by the maximum sound attenuation that can be achieved. Thus, there is a need for a new acoustic building panel exhibiting the desired enhanced acoustical properties.

SUMMARY

According to some embodiments, the present invention is directed to an acoustic ceiling panel comprising a first air-permeable body comprising a first major surface opposite a second major surface and a side surface extending between the first and second major surfaces, the first body having an NRC value of at least 0.5 as measured between the first and second major surfaces of the first body; and an attenuation coating applied to the second major surface of the body and the side surface of the body, whereby the attenuation coating seals at least a portion of the second major surface and the side surface of the body.

Other embodiments of the present invention include an acoustic ceiling panel comprising: a first air-permeable body comprising a first major surface opposite a second major surface and a side surface extending between the first and second major surfaces of the first body, the first major surface comprises a first plurality of openings, the second major surface comprising a second plurality of openings, and the side surface comprising a third plurality of openings, and the first air-permeable body having an NRC value of at least 0.75 as measured between the first and second major surfaces of the first air-permeable body; an attenuation coating applied to the second major surface of the first air-permeable body and the side surface of the first air-permeable body; and an attenuation body comprising a first major surface opposite a second major surface and a side surface extending between the first and second major surfaces of the attenuation body, the attenuation body having a CAC value of at least 40 as measured between the first and second major surfaces of the attenuation body; whereby the attenuation coating is positioned between the first air-permeable body and the attenuation body, and the first major surface of the attenuation body is offset from the second major surface of the first air-permeable body by the attenuation coating.

Other embodiments of the present invention include an acoustic ceiling panel having a first exposed major surface opposite a second major exposed surface and a side exposed surface extending between the first and second major exposed surface, wherein the acoustic ceiling panel comprises a multilayered body having a first layer formed of noise reducing air-permeable material; a second layer of sound attenuation material; and an attenuation coating applied between the first layer and the second layer; wherein the first exposed major surface comprises the noise reducing air-permeable material of the first layer, the second exposed major surface comprises the sound attenuation material of the second layer, and the exposed side surface comprises the first layer, the second layer, and the attenuation coating.

Other embodiments of the present invention include a ceiling system comprising: a ceiling grid comprising a plurality of first members and a plurality of second members, the first and second members intersecting one another to define a plurality of grid openings; a plenary space above the ceiling grid; a room environment below the ceiling grid; and the acoustical ceiling panel according to any one of claims 1 to 45 mounted to the ceiling grid and positioned within the grid opening; wherein the first major surface of the first air-permeable body faces the room environment.

Other embodiments of the present invention include a method of forming an acoustic ceiling panel comprising a) providing a first air-permeable body having a first major surface opposite a second major surface and a side surface extending between the first and second major surfaces, and the first air-permeable body having an NRC value of at least 0.5 as measured between the first and second major surfaces of the first air-permeable body; and b) applying a sound attenuation coating composition to second major surface of the first air-permeable body such that the sound attenuating coating at least partially seals the second major surface of the first air-permeable body.

BRIEF DESCRIPTION OF THE DRAWINGS

The features of the exemplary embodiments of the present invention will be described with reference to the following drawings, where like elements are labeled similarly, and in which.

Figure 1:
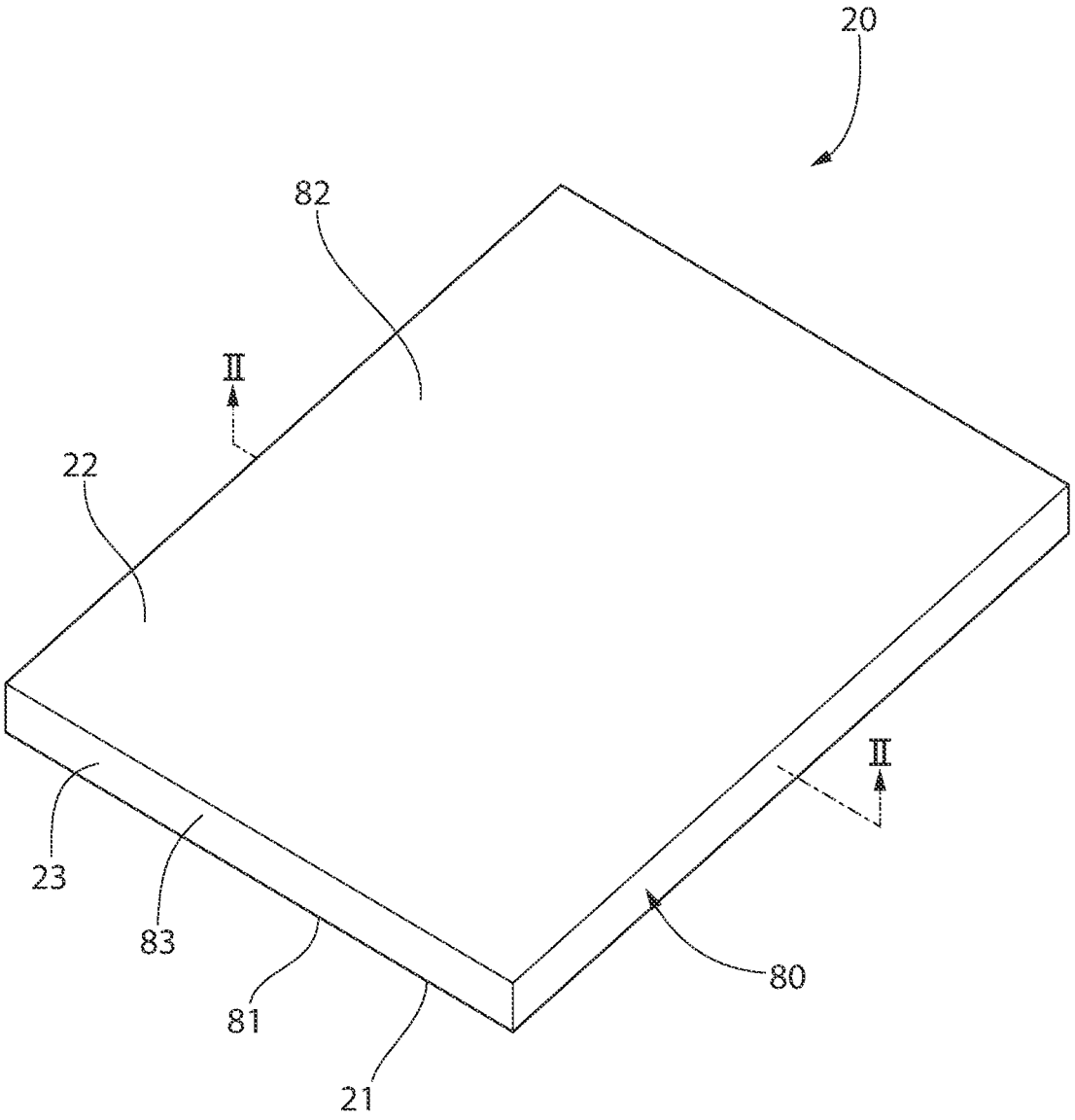
FIG. 1 is a perspective view of an acoustic building panel according to the present invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Figure 3:
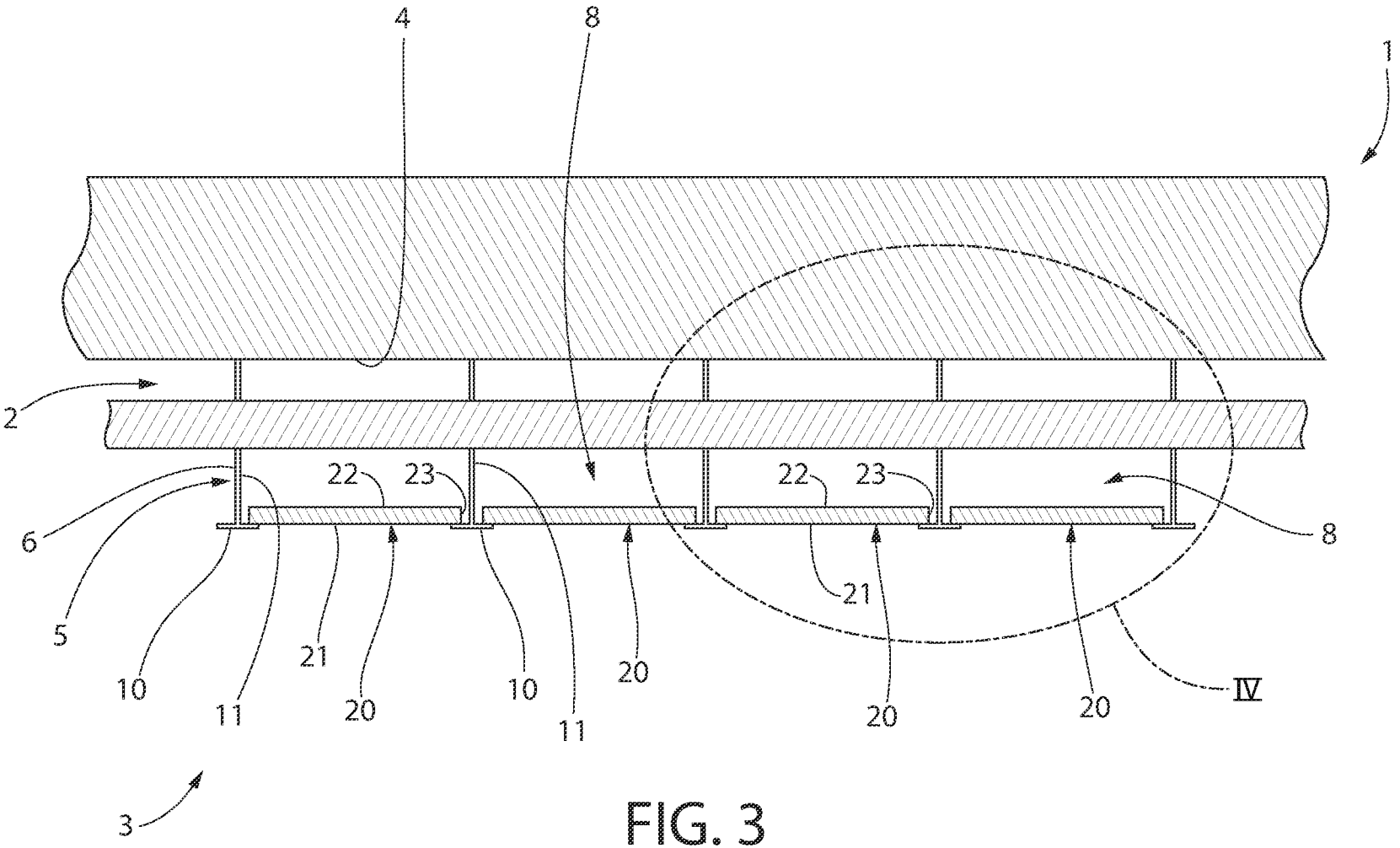
FIG. 3 is a side view of building system comprising a plurality of the acoustic building panels of FIG. 1 according to the present invention.

As shown in FIG. 3, the present invention is directed to a ceiling system 1 comprising a support grid 5 and at least one acoustic building panel 20. A plenary space 2 may exist above the support grid 5. The plenary space 2 is the space that exists above the acoustic building panels 20 and above the support grid 5 and below a roof or a subfloor 4 of an above adjacent floor in a building. The plenary space 2 provides room for mechanical lines to be run throughout a building—e.g. HVAC, plumbing, data lines, etc. A room environment 3 may exist below the acoustic building panels 20 and below the support grid 5. The room environment 3 is the space occupied by inhabitants of a room—e.g. room environments 3 in an office building would be the space occupied by desks, office workers, computers, etc. The combination of the support grid 5 and the acoustic building panels 20 may act as an acoustic, thermal, and aesthetic barrier between the room environment 3 and the plenary space 2, as well as a sound deadening layer for noise that exists within the room environment 3, as discussed herein.

The support grid 5 may comprise a plurality of first struts 6 extending parallel to each other. In some embodiments, the support grid 5 may further comprise a plurality of second struts that extend parallel to each other (not pictured). The plurality of first struts 6 may intersect the plurality of second struts to form a grid pattern having a plurality of grid openings 8. In some embodiments, the plurality of first struts 6 intersects the plurality of second struts 7 at a substantially perpendicular angle, thereby forming rectangular grid openings 8. The rectangular grid openings 8 may be square or any other shape that is aesthetical or functional.

Each of the plurality of first struts 6 and each of the plurality of second struts may comprises T-bars having a horizontal flange 10 and a web 11. The plenary space 2 exists above the T-bars and the room environment 3 exists below the T-bars.

The ceiling system 1 of the present disclosure comprises at least one acoustic building panel 20 that is mounted within of the grid openings 8 of the support grid 5. The ceiling system 1 may comprises a plurality of acoustic building panels 20 mounted to the support grid 5, each of the plurality of acoustic building panels 20 resting within one of the plurality of grid openings 8. In some embodiments, something other than the acoustic building panel 20 (for example, light fixture or an air duct vent) may be mounted to the support grid 5 within at least one of the grid openings 8 (not pictured).

Figure 2:
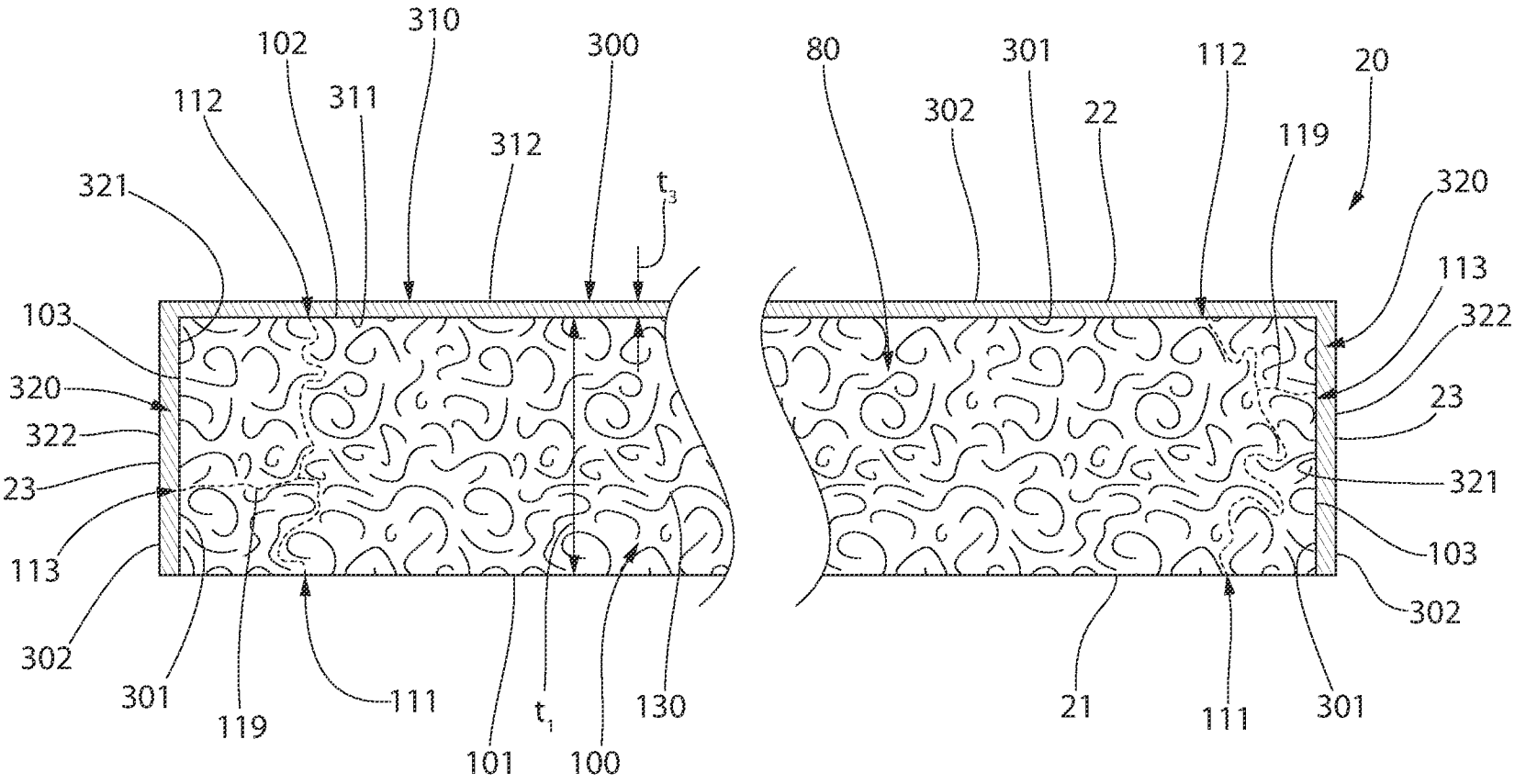
FIG. 2 is a cross-sectional view of the acoustic building panel along line II-II of FIG. 1.

As demonstrated by FIGS. 1 and 2, the acoustic building panel 20 may comprise a first layer that is a first air-permeable body 100 and a sound attenuation coating 300 applied thereto (also referred to as an "attenuation coating"). The combination of the first air-permeable body 100 and the attenuation coating 300 may be referenced as the coated first body 80. In some embodiments of the present invention, the acoustic building panel 20 may further comprise a scrim (not pictured). As demonstrated by FIGS. 3 and 4, the acoustic building panel 20 may be mounted on the support grid 5 of the ceiling system 1 so that the first body 100 of the acoustic building panel 20 is adjacent to the room environment 3 and the attenuation coating 300 is adjacent to the plenary space 2.

Referring now to FIGS. 1 and 2, the acoustic building panel 20 may comprise a first exposed major surface 21 (also referred to as an "upper exposed major surface") opposite a second major exposed surface 22 (also referred to a "lower exposed major surface") and an exposed side surface 23 extending between the first and second exposed major surfaces 21, 22.

The acoustic building panel 20 may have an overall length and width. In some embodiments, the length of the acoustic building panel 20 may range from 12 inches to 96 inches—including all lengths and sub-ranges there-between. In a non-limiting example, the length of the acoustic building panel may be 12, 18, 24, 30, 48, 60, 72, or 96 inches. In some embodiments, the width of the acoustic building panel 20 may range from 4 to 48 inches—including all widths and sub-ranges there-between. In a non-limiting example, the acoustic building panel 20 may have a width of 4, 6, 12, 18, 20, 24, 30, or 48 inches.

The first air-permeable body 100 may comprise a first major surface 101 (also referred to a "lower major surface") that is opposite a second major surface 102 (also referred to as an upper major surface 102) as well as side surfaces 103 that extends between the first and second major surfaces 101, 102 of first air-permeable body 100. The first air-permeable body 100 may have an overall length and width. The length of the first air-permeable body may be substantially equal to the length of the acoustic building panel 20. The width of the first air-permeable body may be substantially equal to the width of the acoustic building panel 20.

The first air-permeable body 100 may have a first thickness $t_1$ as measured by the distance between the first and second major surfaces 101, 102 of the first air-permeable body 100. The first thickness $t_1$ may range from about 0.25 inches to about 3.0 inches—including all thickness and sub-ranges there-between.

According to some embodiments, the first major surface 101 of the first air-permeable body 100 may have a first length and a first width and the second major surface 102 of the first air-permeable body 100 may have a second length and a second width. According to some embodiments, the first width of the first major surface 101 may be substantially equal to the second width of the second major surface 102. According to some embodiments, the first length of the first major surface 101 may be substantially equal to the second length of the second major surface 102. In other embodiments, the first width of the first major surface 101 may be less than the second width of the second major surface 102. According to some embodiments, the first length of the first major surface 101 may be less than the second length of the second major surface 102.

Figure 5A:
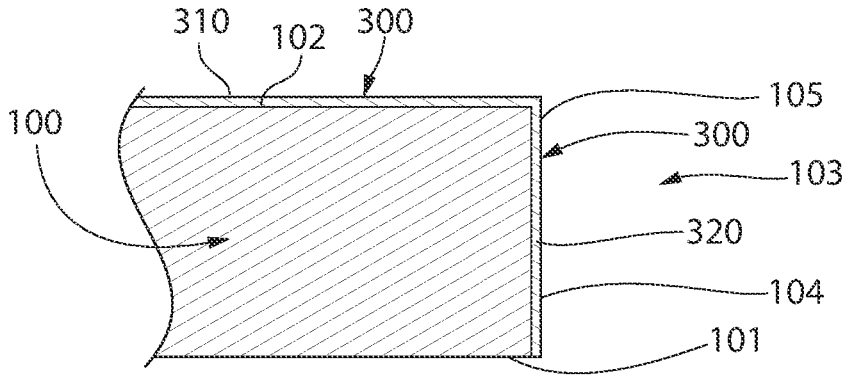
FIG. 5A is a cross-sectional view of edge portion of the acoustic building panels according to a number of embodiments of the present invention.
Figure 5B:
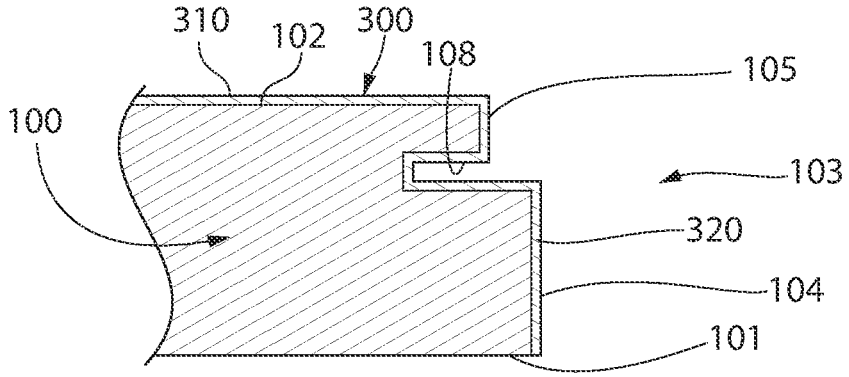
FIG. 5B is a cross-sectional view of edge portion of the acoustic building panels according to a number of embodiments of the present invention.
Figure 5C:
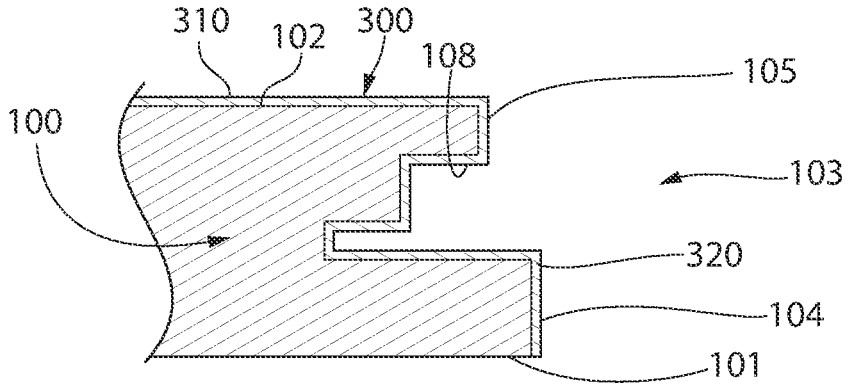
FIG. 5C is a cross-sectional view of edge portion of the acoustic building panels according to a number of embodiments of the present invention.
Figure 5D:
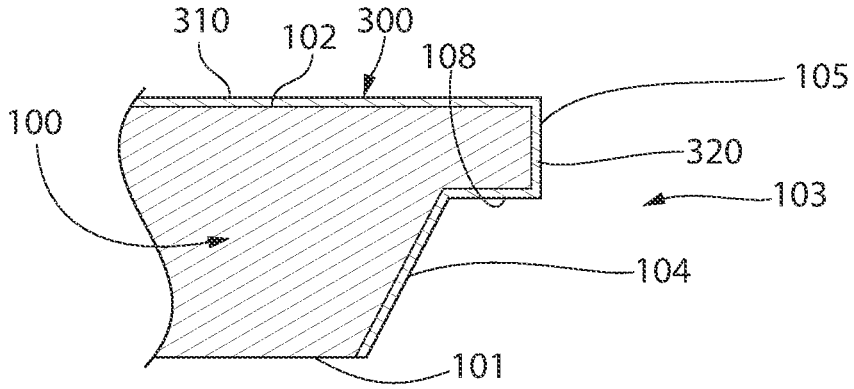
FIG. 5D is a cross-sectional view of edge portion of the acoustic building panels according to a number of embodiments of the present invention.
Figure 6:
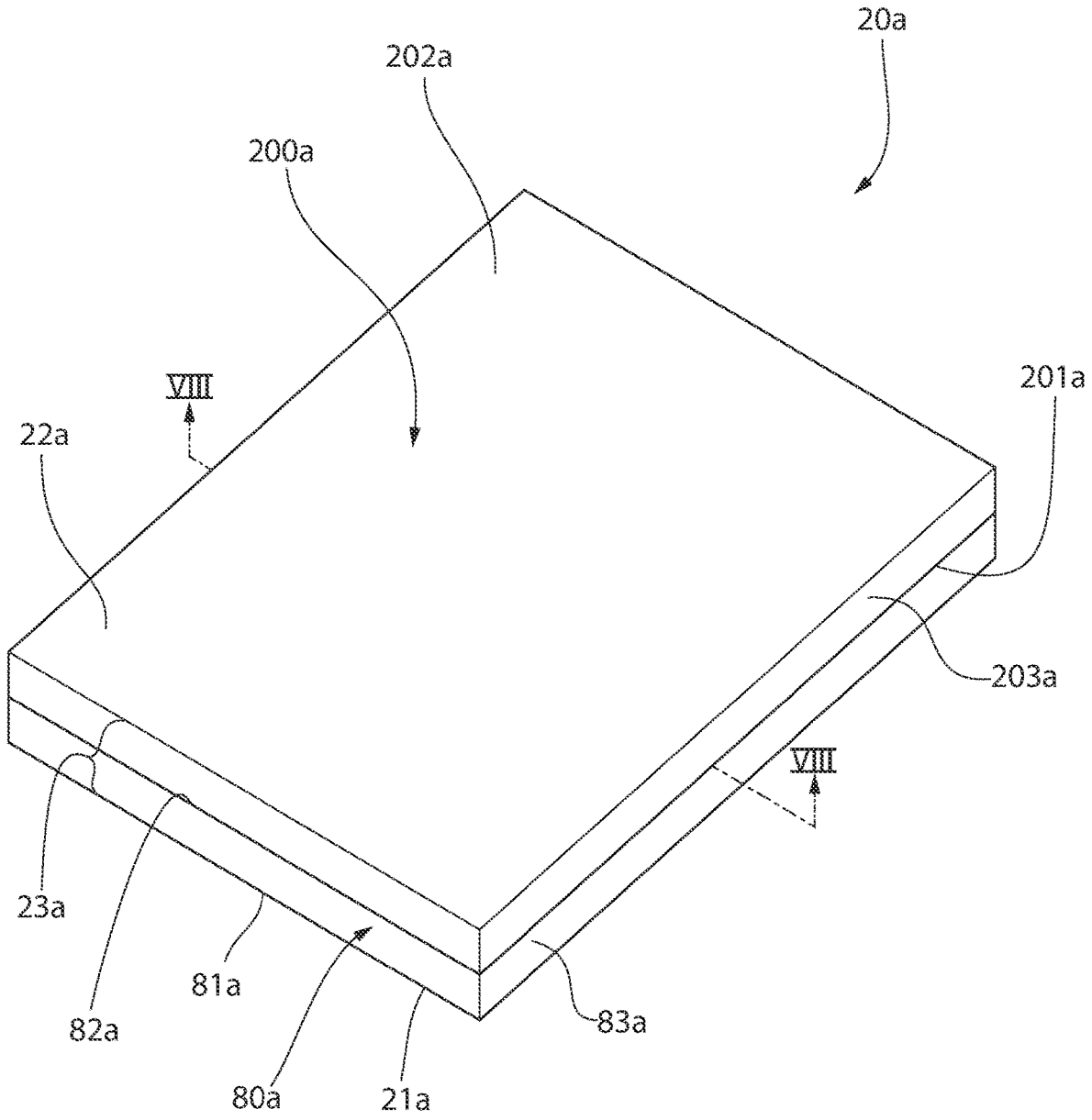
FIG. 6 is a perspective view of an acoustic building panel according to another embodiment of the present invention.
Figure 7:
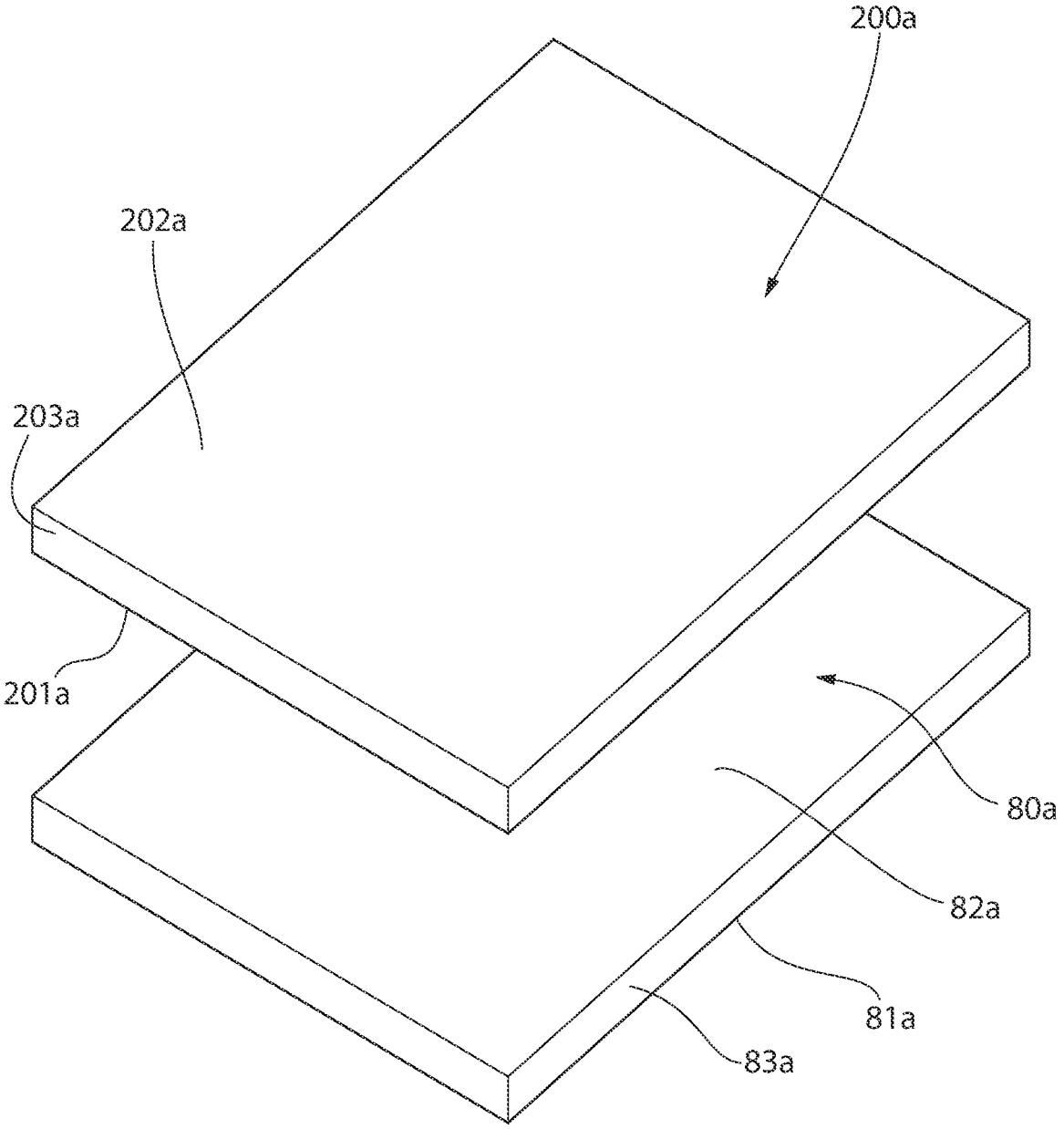
FIG. 7 is an exploded perspective view of the acoustic building panel of FIG. 6.
Figure 8:
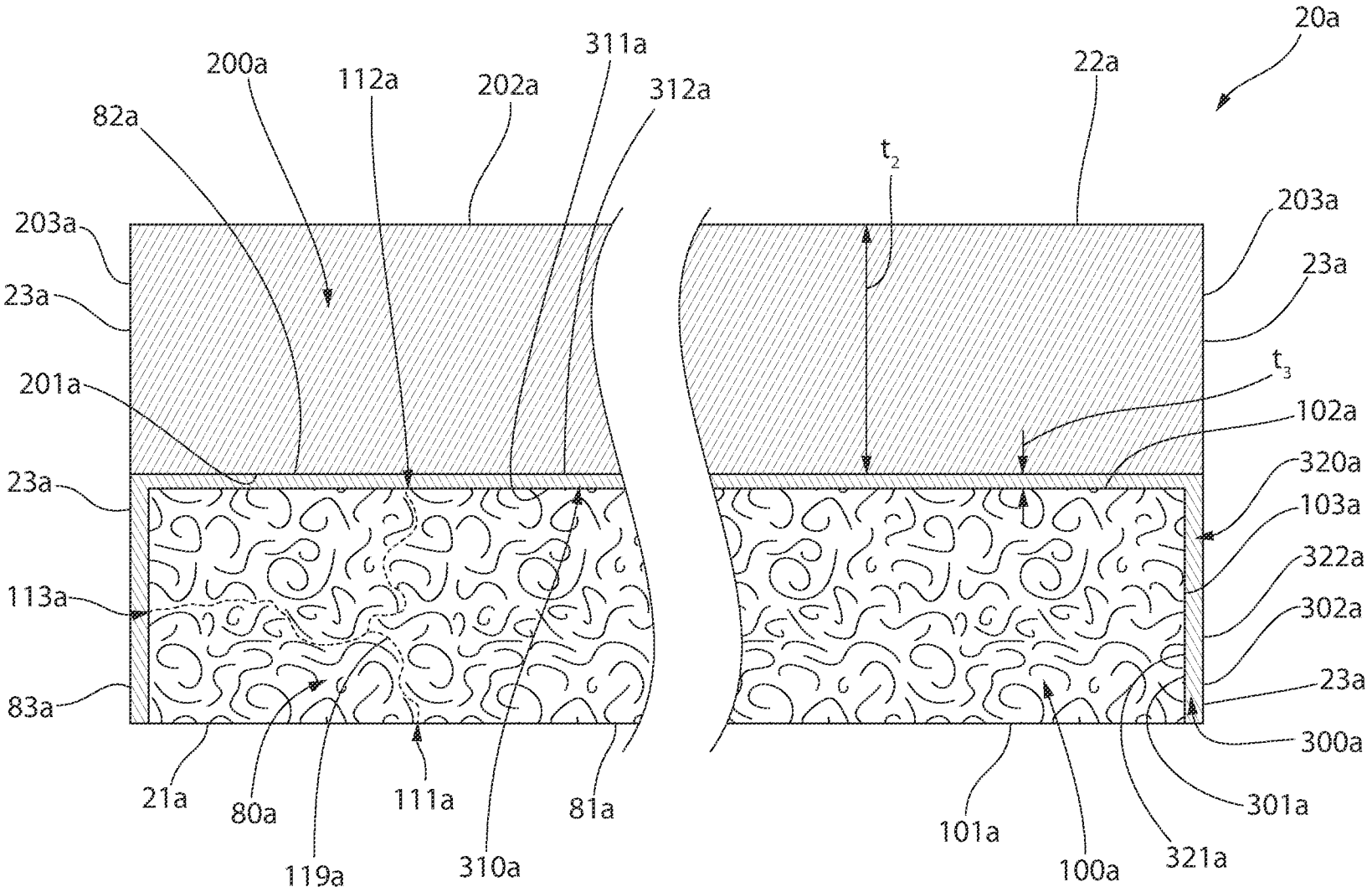
FIG. 8 is a cross-sectional view of the acoustic building panel along line VII-VII of FIG. 6.

Referring now to FIGS. 5B-5D, the side surface 103 of the first air-permeable body 100 may comprise a stepped profile having an upper side surface 105 and a lower side surface 104. An intermediate surface 108 may extend between the lower side surface 104 and the upper side surface 105 in a direction that is substantially perpendicular to the side surface 103, the upper side surface 105, and the lower side surface 104 of the ceiling panel 100. In some embodiments, the intermediate surface 108 faces the same direction as the lower major surface 101 of the ceiling panel 100. In other embodiments, the intermediate surface 108 faces a direction oblique to the lower major surface 101.

The stepped profile comprises the combination of the upper side surface 105, the intermediate surface 108, and the lower side surface 104. The second major surface 102 of the first air-permeable body 100 may have a surface area that is greater than a surface area of the first major surface 101 of the first air-permeable body 100—as demonstrated by FIG. 5D. In other embodiments, the second major surface 102 of the first air-permeable body 100 has a surface area that is less than the surface area of the first major surface 101 of the first air-permeable body 100—as demonstrated by FIGS. 5B, 5C. In other embodiments, the first air-permeable body 100 may not have a stepped profile, whereby the second major surface 102 of the first air-permeable body 100 has a surface area that is substantially equal to the surface area of the first major surface 101 of the first air-permeable body 100—as demonstrated by FIG. 5A.

In some embodiments, the stepped profile of the first air-permeable body 100 may be present on each of the side surfaces 103 of the ceiling panel 100. In other embodiments, the stepped profile may only be present on two opposite side surfaces 103 of the first air-permeable body 100.

Referring now to FIG. 2, the first air-permeable body 100 may be a porous structure. The term "porous structure" refers to the first air-permeable body 100 comprising a plurality of open pathways 119 that extend between a plurality of first openings 111 present on the first major surface 101, a plurality of second openings 112 present on the second major surface 102, and a plurality of third openings 113 present on the side surfaces 103 of the first air-permeable body 100. The open pathways 119 may extend directly or indirectly between the plurality of first openings 111 and the plurality of second openings 112. The open pathways 119 may extend directly or indirectly between the plurality of third openings 113 and plurality of second openings 112. The open pathways 119 may extend directly or indirectly between the plurality of first openings 111 and the plurality of third openings 112.

The open pathways 119 are indicated by dotted line in FIG. 2 solely for exemplary purposes and to indicate a how air may flow through the first air-permeable body 100 and between the first major surface 101, the second major surface 102, and/or the third major surface 103. The open pathway 119 of the first air-permeable body 100 may not be limited in ultimate distance or how tortuous the pathway may be between the first major surface 101, the second major surface 102, and/or the third major surface 103. As discussed further herein, the open pathways 119 are open voids within the first air-permeable body 100 that allow for airflow through and between the first major surface 101, the second major surface 102, and/or the third major surface 103, as well as within the first air-permeable body 100. The open pathways 119 may be considered to create fluid communication between various points within the first air-permeable body 100.

The first air-permeable body 100 may comprise a fibrous material 130. The first air-permeable body 100 may comprise a filler (not pictured). The first air-permeable body 100 may comprise a binder (not pictured).

The fibrous material 130 may comprise an organic fiber. The fibrous material 130 may comprise an inorganic fiber. Non-limiting examples of inorganic fiber include fiberglass, mineral wool (also referred to as slag wool), rock wool, stone wool, and glass fibers (fiberglass). Non-limiting examples of organic fiber include cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof. Depending on the specific type of material, the fibers 130 may either be hydrophilic (e.g., cellulosic fibers) or hydrophobic (e.g. fiberglass, mineral wool, rock wool, stone wool). The fibrous material may be present in an amount ranging from about 5 wt. % to about 99 wt. % based on the total dry weight of the first air-permeable body 100—including all values and sub-ranges there-between.

The phrase "dry-weight" refers to the weight of a referenced component without the weight of any carrier. Thus, when calculating the weight percentages of components in the dry-state, the calculation should be based solely on the solid components (e.g., binder, filler, fibrous material, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier—as discussed further herein. The dry-state may refer to the coatings having a solids content of at least about 99 wt. % based on the total weight of the coating—such amount may allow for minor amounts (up to about 1 wt. %) of residual liquid carrier that may be present in the coating after drying.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, polyvinyl acetate, epoxy resins, or a combination of two or more thereof. The binder may be present in an amount ranging from about 1.0 wt. % to about 25.0 wt. % based on the total dry weight of the air-permeable body 100—including all percentages and sub-ranges there-between. In a preferred embodiment, the binder may be present in an amount ranging from about 3.0 wt. % to about 10.0 wt. % based on the total dry weight of the air-permeable body 100—including all percentages and sub-ranges there-between.

Non-limiting examples of filler may include powders of calcium carbonate, including limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate. The filler may be present in an amount ranging from about 0 wt. % to about 80 wt. % based on the total dry weight of the body 120—including all values and sub-ranges there-between. In other embodiments, the filler may be present in an amount ranging from about 5 wt. % to about 70 wt. % based on the total dry weight of the body 120—including all values and sub-ranges there-between.

In non-limiting embodiments, the air-permeable body 100 may further comprise one or more additives include defoamers, wetting agents, biocides, dispersing agents, flame retardants (such as alumina tri-hydrate), and the like. The additive may be present in an amount ranging from about 0.01 wt. % to about 30 wt. % based on the total dry weight of the air-permeable body 100—including all values and sub-ranges there-between.

The first air-permeable body 100 may have a first density ranging from about 2 lb/ft$^3$ to about 16 lb/ft$^3$—including all densities and sub-ranges there-between. The first air-permeable body 100 may have a first rigidity. In a preferred, embodiment the first air-permeable body 100 may have a first density ranging from about 5 lb/ft$^3$ to about 14 lb/ft$^3$—including all densities and sub-ranges there-between. The first air-permeable body 100 may have a first rigidity.

The first air-permeable body 100 may be porous and allow for sufficient airflow via the open pathways 119 such that the first air-permeable body 100 has the ability to reduce the amount of reflected sound in a room environment 2. Specifically, air may enter at least one of the plurality of first openings 111, the plurality of second openings 112, and/or the plurality of third openings 113 and flow throughout the open pathways 119 within the first air-permeable body 100, thereby helping dissipate noise from the environment from which the air entered the corresponding plurality of openings 111, 112, 113.

The reduction in amount of reflected sound in a room is expressed by a Noise Reduction Coefficient (NRC) rating as described in American Society for Testing and Materials (ASTM) test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The first air-permeable body 100 may exhibits an NRC of at least about 0.5 as measured between the first and second major surfaces 101, 102 of the first air-permeable body. In a preferred embodiment, the first air-permeable body 100 of the present invention may have an NRC ranging from about 0.60 to about 0.99—including all value and sub-ranges there-between—as measured between the first and second major surfaces 101, 102 of the first air-permeable body. Non-limiting examples of NRC value for the first air-permeable body include 0.65, 0.7, 0.75, 0.8, 0.85, 0.9, 0.95—as measured between the first and second major surfaces 101, 102 of the first air-permeable body.

As the amount of airflow that is capable of entering the first air-permeable body 100 via one of more of the plurality of first, second, and side openings 111, 112, 113 increases, the NRC value of the corresponding first air-permeable body 100 generally increases. Therefore, there is a generally inverse relationship to airflow resistance of the first air-permeable body 100 and the NRC value of that first air-permeable body 100.

The first air-permeable body 100 may have a first airflow resistance ($R_1$) that is measured through the first air-permeable body 100 at the first major surface 101 (or the second major surface 102). Airflow resistance is a measured by the following formula:

$$R=(P_A-P_{ATM})/\dot{V}$$

Where R is air flow resistance (measured in ohms); $P_A$ is the applied air pressure; $P_{ATM}$ is atmospheric air pressure; and V is volumetric airflow. The first airflow resistance ($R_1$) of the first air-permeable body 100 may range from about 0.5 ohm to about 50 ohms. In a preferred embodiment, the airflow resistance of the first air-permeable body 100 may range from about 0.5 ohms to about 35 ohms.

The first air-permeable body 100 may have a porosity ranging from about 60% to about 98%—including all values and sub-ranges there between. In a preferred embodiment, the first air-permeable body 100 may have a porosity ranging from about 75% to 95%—including all values and sub-ranges there between. According to the present invention, porosity refers to the following:

$$\% \text{ Porosity}=[V_{Total}-(V_{Binder}+V_{Fibers}+V_{Filler})]/V_{Total}$$

Where $V_{Total}$ refers to the total volume of the first air-permeable body 100 as defined by the first major surface 101, the second major surface 102, and the side surfaces 103. $V_{Binder}$ refers to the total volume occupied by the binder in the air-permeable body 100. $V_{Fibers}$ refers to the total volume occupied by the fibrous material 130 in the first air-permeable body 100. $V_{Filler}$ refers to the total volume occupied by the filler in the first air-permeable body 100. Thus, the % porosity represents the amount of free volume within the first air-permeable body 100—whereby the free volume forms the open pathways 119 of the first air-permeable body 100. Thus, as porosity increases, the resulting airflow resistance of the first air-permeable body 100 decreases and NRC value increases.

Referring now to FIGS. 2, the acoustic building panel 20 of the present invention further comprises an attenuation coating 300 applied to the first air-permeable body 100. Specifically, the attenuation coating 300 may be applied to the second major surface 102 of the first air-permeable body 100. The attenuation coating 300 may be further applied to the side surface 103 of the first air-permeable body 100. In a preferred embodiment, the attenuation coating 300 may be applied to both the second major surface 102 and the side surface 103 of the first air-permeable body 100. The attenuation coating 300 may extend continuously from the second major surface 102 of the first air-permeable body 100 to the side surface 103 of the first air-permeably body 100.

The attenuation coating 300 may comprise a polymer binder. The polymeric binder may be present in an amount ranging from about 1 wt. % to about 20 wt. % based on the total weight of the dry-state attenuation coating 300—including all percentages and sub-ranges there-between. Non-limiting examples of binder may include a starch-based polymer, polyvinyl alcohol (PVOH), a latex, polysaccharide polymers, polyvinyl acetate, cellulosic polymers, protein solution polymers, an acrylic polymer, polymaleic anhydride, epoxy resins, or a combination of two or more thereof.

In an alternative embodiment, the attenuation coating may comprise a primer coating comprising the attenuation coating composition whereby no binder is used—i.e. 0 wt. % of binder. Subsequent attenuation coatings applied to the primer coating would comprise binder.

The attenuation coating may comprise a filler. The filler may be present in an amount ranging from about 30 wt. % to about 99 wt. % based on the total weight of the dry-state attenuation coating 300—including all percentages and sub-ranges there-between. In a preferred embodiment, the filler may be present in an amount ranging from about 50 wt. % to about 99 wt. % based on the total weight of the dry-state attenuation coating 300—including all percentages and sub-ranges there-between. Non-limiting examples of filler may include pigments, powders of calcium carbonate, including limestone, titanium dioxide, sand, barium sulfate, clay, mica, dolomite, silica, talc, perlite, polymers, gypsum, wollastonite, glass, expanded-perlite, calcite, aluminum trihydrate, pigments, zinc oxide, or zinc sulfate.

In a non-limiting example, the attenuation coating 300 may be applied in the wet-state to the first air-permeable body 100 by spray, roll, curtain coating, screen printing, extrusion coating, or dip application. The attenuation coating 300 may comprise a liquid carrier in the wet-state that is present in an amount ranging from about 20 wt. % to about 60 wt. % based on the total weight of the wet-state attenuation coating—including all percentages and sub-ranges there-between. The attenuation coating 300 may have a solids content in the wet-state that ranges from about 40 wt. % to about 80 wt. % based on the total weight of the wet-state attenuation coating—including all percentages and sub-ranges there-between.

The attenuation coating 300 may comprise an inner surface 301 opposite an outer surface 302. The attenuation coating 300 may have a coating thickness $t_3$ as measured by the distance between the inner and outer surfaces 301, 302 of the attenuation coating 300. Although not limited to, the coating thickness $t_3$ may range from about 5.0 mils to about 15 mils—including all thicknesses and sub-ranges there-between. The inner surface 301 may face the first air-permeable body 100. The outer surface 302 may face away the first air-permeable body 100.

The ratio of the first thickness $t_1$ of the first air-permeable body 100 to the coating thickness $t_3$ may be at least 20:1. In a non-limiting embodiment, the ratio of the first thickness $t_1$ of the first air-permeable body 100 to the coating thickness $t_3$ may be at least 30:1. In a non-limiting embodiment the ratio of the first thickness $t_1$ of the first air-permeable body 100 to the coating thickness $t_3$ may range from about 30:1 to about 150:1—including all ratios and sub-ranges there-between. In a non-limiting embodiment the ratio of the first thickness $t_1$ of the first air-permeable body 100 to the coating thickness $t_3$ may range from about 30:1 to about 100:1—including all ratios and sub-ranges there-between.

The attenuation coating 300 that is applied to the second major surface 102 of the first air-permeable body 100 may form a top attenuation coating 310. The top attenuation coating 310 may comprise an inner surface 311 opposite an outer surface 312. The inner surface 312 of the top attenuation coating 310 may face the second major surface 102 of the first air-permeable body 100. The outer surface 311 of the top attenuation coating 310 may face away from the second major surface 102 of the first air-permeable body 100. The top attenuation coating 310 may have a thickness as measured by the distance between the inner and outer surfaces 311, 312 of the top attenuation coating 310 that is substantially equal to the coating thickness $t_3$.

The attenuation coating that is applied to the side surface 103 of the first air-permeable body 100 may form a side attenuation coating 320. The side attenuation coating 320 may comprise an inner surface 321 opposite an outer surface 322. The inner surface 322 of the side attenuation coating 320 may face the side surface 103 of the first air-permeable body 100. The outer surface 321 of the side attenuation coating 320 may face away from the side surface 103 of the first air-permeable body 100. The side attenuation coating 320 may have a thickness as measured by the distance between the inner and outer surfaces 321, 322 of the side attenuation coating 320 that is substantially equal to the coating thickness $t_3$.

Once applied, the combination of the attenuation coating 300 and the first air-permeable body 100 form a coated noise-reducing attenuation body 80 (also referred to as "coated body" 80). In some embodiments, the coated body 80 may form the acoustic building panel 20. In other embodiments, the coated body 80 may form a portion of the acoustic building panel 20—as discussed further herein.

The coated body 80 may comprise a first major surface 81 opposite a second major surface 82 as well as side surfaces 83 that extend between the first and second major surfaces 81, 82 of the coated layer 82. The first major surface 81 of the coated body 80 may comprise the first major surface 101 of the first air-permeable body 100. The second major surface 82 of the coated body 80 may comprise the attenuation coating 300—specifically, top attenuation coating 310. In particular, the second major surface 82 of the coated body 80 may comprise the outer surface 312 of the top attenuation coating 310. The side surface 83 of the coated body 80 may comprise the attenuation coating 300—specifically, side attenuation coating 320. In particular, the side surface 83 of the coated body 80 may comprise the outer surface 322 of the side attenuation coating 320.

According to the embodiments there the acoustic building panel 20 is formed essentially from the coated body 80, the first major exposed surface 21 of the acoustic building panel 20 may comprise the first major surface 81 of the coated body 80—i.e., the first major exposed surface 21 may comprise the first major surface 101 of the air-permeable layer 100. According to such embodiments, the second major exposed surface 22 may comprise the second major surface 82 of the coated body 80—i.e., the second major exposed surface 22 of the acoustic building panel 20 may comprise the outer surface 311 of the top attenuation coating 310. According to such embodiments, the side exposed surface 23 may comprise the side surface 83 of the coated body 80—i.e., the side exposed surface 23 may comprise the outer surface 321 of the side attenuation coating 320. According to such embodiments, the side exposed surface 23 may be one or more of the side surface geometries set forth in FIGS. 5A-5D.

The attenuation coating 300 may be applied to the first air-permeable body 100 such that the attenuation coating 300 seals at least a portion of the second major surface 102 of the first air-permeably body 100. The attenuation coating 300 may be applied to the first air-permeable body 100 such that the attenuation coating 300 seals at least a portion of the side surface 103 of the first air-permeably body 100. In particular, the top attenuation coating 310 may be applied to the second major surface 102 of the first air-permeable body 100 such that the top attenuation coating 310 seals at least a portion of the plurality of second openings 112 of the first air-permeably body 100. In particular, the side attenuation coating 320 may be applied to the side surface 103 of the first air-permeable body 100 such that the side attenuation coating 320 seals at least a portion of the plurality of third openings 113 of the first air-permeably body 100.

The term "seal" according to the present invention refers to at least partially closing and/or blocking the openings that are in fluid communication with the open pathways 119 that are present on the air-permeable body 100. Therefore, when the second major surface 102 and/or side surface 103 is sealed by the attenuation coating 300, open pathways 119 may still be unblocked and allow for airflow therein. However, the airflow may terminate once reaching the second major surface 102 and/or side surface 103 of the first air-permeable body 100 as the outlet formed by the openings 112, 113 are at least partially (or fully) closed/blocked.

The degree of blockage provided by the attenuation coating seal for each opening 112, 113 present on the second major surface 102 and side surface 103 of the first air-permeable body 100 may be reflected by the increase in airflow resistance between the naked air-permeably body 100 and the coated layer, as discussed further herein.

As such, the present invention provides that the coated body 80 may allow for airflow to enter the air-permeable body 100 at the first major surface 101 and travel through the open pathways 119 within the first air-permeably body 100 but will substantially terminate at the second major surface 102 and/or side surface 103 when reaching the corresponding attenuation coating 300 applied thereto.

The top attenuation coating 310 may be present on the second major surface 102 of the first air-permeable body 100 in an amount ranging from about 10 g/ft$^2$ to about 45 g/ft$^2$—including all amounts and sub-ranged there-between. In a preferred embodiment, the top attenuation coating 310 may be present on the second major surface 102 of the first air-permeably body 100 in an amount ranging from about 14 g/ft$^2$ to about 30 g/ft$^2$ including all amounts and sub-ranged there-between.

The top attenuation coating 310 may be applied as one or more sub-layers that together form the full top attenuation coating 310. The sub-layers may comprise a first sub-layer and a second sublayer. The first sub-layer, which may also be referred to as a "primer layer," may be applied directly to the second major surface 102 of air-permeably body 100, and the second sub-layer may be applied directly to the first sub-layer. In certain embodiments, additional sub-layers may be applied atop the second sub-layer. The first sub-layer may be applied in a dry amount ranging from about 5 g/ft$^2$ to about 25 g/ft$^2$—including all amounts and sub-ranges there-between. The second sub-layer may be applied in a dry amount ranging from about 5 g/ft$^2$ to about 20 g/ft$^2$—including all amounts and sub-ranges there-between.

The application of the top attenuation coating 310 as two or more sub-layers helps maintain the NRC performance of the first air-permeably body 100 while still providing the desired attenuation properties of the resulting coated body 80, because the first sub-layer may be applied as a fraction of the overall top attenuation coating 310, thereby reducing the overall depth of which the attenuation coating penetrates into the first air-permeably body 100. In a non-limiting embodiment, the top attenuation coating 310 may be formed from three sub-layers. In a non-limiting embodiment, the top attenuation coating 310 may be formed from four sub-layers. The result is a coated body 80 that has the majority of the top attenuation coating 310 remain atop the second major surface 102 of the first-air permeably body.

The side attenuation coating 320 may be present on the side surface 103 of the first air-permeably body 100 in a dry amount ranging from about 4 to about 8 grams/linear foot—including all amounts and sub-ranged there-between. In a preferred embodiment, the side attenuation coating 320 may be present on the side surface 103 of the first air-permeable body 100 in an amount ranging from about 5 g/linear foot to about 6 g/linear foot—including all amounts and sub-ranged there-between. In a non-limiting embodiment, a building panel having a length and width of about 2', the resulting side attenuation coating 320 would be present in an amount of about 8 grams to about 16 grams.

The coated body 80 may comprise a second airflow resistance as measured at the first major surface 81 of the coated body 80 where the first major surface 101 of the first air-permeably body 100 is still exposed. The second air flow resistance may be substantially equal to the first airflow resistance. In some embodiments, the second air flow resistance may up to 33% greater than the first airflow resistance.

The coated body 80 may comprise a third airflow resistance as measured at the second major surface 82 of the coated body 80 where the sound attenuation coating 300 (the top attenuation coating 310) is located. The third airflow resistance is greater than the first airflow resistance. In some embodiments, the third airflow resistance is at least one order of magnitude greater than the second airflow resistance. In some embodiments, the third airflow resistance is at least one order of magnitude greater than the first airflow resistance. In some embodiments, the third airflow resistance is at least two orders of magnitude greater than the second airflow resistance. In some embodiments, the third airflow resistance is at least two orders of magnitude greater than the first airflow resistance.

The ratio of the third airflow resistance to the second airflow resistance may range from about 10:1 to about 100:1—including all ratios and sub-ranges there-between. The ratio of the third airflow resistance to the first airflow resistance may range from about 10:1 to about 100:1—including all ratios and sub-ranges there-between.

The coated body 80, when installed in a ceiling system 1, may result in a ceiling system 1 that exhibits a CAC value ranging from about 25 dB to about 42 dB—including all values and sub-ranges there-between. In a preferred embodiment, the CAC value of ceiling system 1 comprising the coated body 80 may range from about 30 dB to about 42 dB—including all percentages and sub-ranges there-between. The sound attenuation value can be ascertained by measuring the ceiling attenuation class ("CAC") as described in ASTM E1414.

According to some embodiments, the acoustic building panel 20 of the present invention may further comprise a non-woven scrim that may be adhesively attached to the first major surface 101 of the first air-permeable body 100. The exposed face of the non-woven scrim may be painted.

Figure 4:
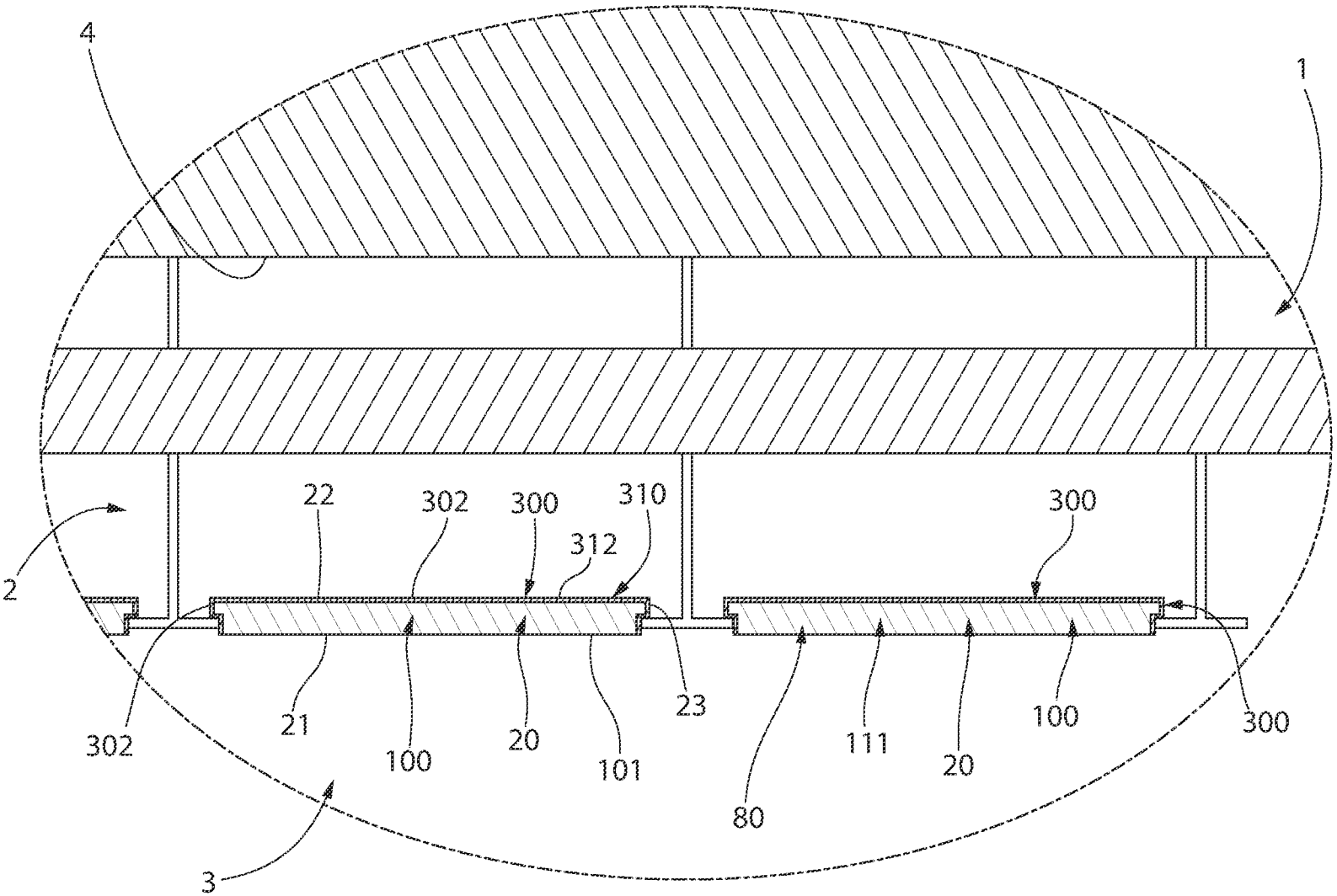
FIG. 4 is a close-up cross-sectional view of region IV of the building system of FIG. 3.

Referring now to FIGS. 3 and 4, the acoustic building panel 20 of this embodiment may be positioned within a ceiling system 1 such that the first major surface 21 of the acoustic building panel faces the active room environment 3 and the second major surface 22 faces the plenary space 2. Specifically, the acoustic building panel 20 of this embodiment may be positioned within a ceiling system 1 such that the first major surface 101 of the first air-permeable body 100 faces the active room environment 3 and outer surface 302 of the attenuation coating faces at least a portion of the plenary space 2. The acoustic building panel 20 of this embodiment may be positioned within a ceiling system 1 such that the first major surface 101 of the first air-permeable body 100 faces the active room environment 3 and outer surface 312 of the top attenuation coating 310 faces at least a portion of the plenary space 2. The acoustic building panel 20 of this embodiment may be positioned within a ceiling system 1 such that the first major surface 101 of the first air-permeable body 100 faces the active room environment 3 and outer surface 322 of the side attenuation coating 320 faces a portion of both the plenary space 2 and the active room environment 3. In other embodiments, the acoustic building panel 20 of this embodiment may be positioned within a ceiling system 1 such that the first major surface 101 of the first air-permeable body 100 faces the active room environment 3 and the entire outer surface 322 of the side attenuation coating 320 faces the plenary space 2.

Referring now to FIGS. 6-10, an acoustic building panel **20*a* is illustrated in accordance with another embodiment of the present invention. The acoustic building panel 20*a* is similar to the acoustic building panel 20 except as described herein below. The description of the acoustic building panel 20 above generally applies to the acoustic building panel 20*a* described below except with regard to the differences specifically noted below. A similar numbering scheme will be used for the acoustic building panel 20*a* as with the acoustic building panel 20** except that the numbers having the suffix "a" will be used.

According to this embodiment, the acoustic building panel **20*a* may further comprise a second layer 200*a* that imparts sound attenuation properties to the acoustic building panel 20*a*. The second layer 200*a* may be referred to as an "attenuation body" or an "attenuation layer." The attenuation body 200*a* may comprise a first major surface 201*a* (also referred to a "lower major surface") that is opposite a second major surface 202*a* (also referred to as an "upper major surface") as well as side surfaces 203*a* that extends between the first and second major surfaces 201*a*, 202*a* of attenuation body 200*a*. The sound attenuation body 200*a* may have an overall length and width. The length of the sound attenuation body 200*a* may be substantially equal to the length of the acoustic building panel 20*a*. The width of the sound attenuation body 200*a* may be substantially equal to the width of the acoustic building panel 20*a***.

The sound attenuation body **200*a* may have a second thickness $t_2$ as measured by the distance between the first and second major surfaces 201*a*, 202*a* of the sound attenuation body 200*a***. The second thickness $t_2$ may range from about 0.25 inches to about 1.5 inches—including all thickness and sub-ranges there-between.

According to some embodiments, the length of the sound attenuation body **200*a* may be substantially equal to the second length of the second major surface 102*a* of the first air-permeably body 100*a*. According to some embodiments, the width of the sound attenuation body 200*a* may be substantially equal to the second width of the second major surface 102*a* of the first air-permeably body 100*a***.

In some embodiments the sound attenuation body **200*a* may be formed of a material selected from fiberglass, mineral wool (such as rock wool, slag wool, or a combination thereof), synthetic polymers (such as melamine foam, polyurethane foam, or a combination thereof), mineral cotton, silicate cotton, gypsum, or combinations thereof. In some embodiments, the sound attenuation body 200*a* predominantly provides a sound attenuation function and preferred materials for providing the sound attenuation function for the sound attenuation layer 200*a*. In some embodiments the sound attenuation body 200*a*** is produced from gypsum board, cement board, granite, and ceramic board.

The sound attenuation body **200*a* may have a second density ranging from about 16 $lb/ft^3$ to about 180 $lb/ft^3$—including all densities and sub-ranges there-between. In a preferred embodiment, the sound attenuation body 200*a* may have a second density ranging from about 25 $lb/ft^3$ to about 100 $lb/ft^3$—including all densities and sub-ranges there-between. A ratio of the second density to the first density of the first air-permeable body 100** may range from about 1.5:1 to about 10:1—including all densities and sub-ranges there-between. In a preferred embodiment, the ratio of the second density to the first density may be at least 2:1, preferably 3:1. In some embodiments, the ratio of the second density to the first density may be about 4:1. In some embodiments, the ratio of the second density to the first density may range from about 1.5:1 to about 2:1.

The sound attenuation body **200*a*, when installed in a ceiling system 1*a*, may result in a ceiling system 1*a* that exhibits a CAC value ranging from about 35 dB, preferably at least 37 dB, preferably at least 40 dB. The sound attenuation body 200*a* may have a second rigidity. The second rigidity may be greater than the first rigidity. In some embodiments, the first rigidity of the ceiling panel 100 and the second rigidity of the sound attenuation layer 100** are equal.

The acoustic building panel 20*a* of this embodiment may be formed by positioning the sound attenuation body 200*a* atop the coated body 80*a*. Specifically, the first major surface 201*a* of the sound attenuation body 200*a* may be placed in contact with the second major surface 82*a* of the coated body 80*a*. In some embodiments, adhesive may be applied between the first major surface 201*a* of the sound attenuation body 200*a* and the second major surface 82*a* of the coated body 80*a*, thereby adhesively bonding together the sound attenuation layer 200*a* and the coated body 80*a*. In other embodiments, the first major surface 201*a* of the sound attenuation body 200*a* may be free-floating contact with the second major surface 82*a* of the coated body 80*a*. In other embodiments, the sound attenuation body 200*a* may be coupled to the coated body 80*a* by mechanical fastener.

In particular, the outer surface 311 of the top attenuation coating 310 may be in contact with the first major surface 201*a* of the sound attenuation layer 200. In some embodiments, adhesive may be applied between and contact both the outer surface 311 of the top attenuation coating 310 and the first major surface 201*a* of the sound attenuation layer 200, thereby adhesively bonding together the sound attenuation layer 200*a* and the coated body 80*a*.

Therefore, the acoustic building panel 20*a* of this embodiment may comprise the attenuation coating 300*a* sandwiched between the first air-permeable body 100*a* and the sound attenuation body 200*a*. The second major surface 102*a* of the first air-permeable body 100*a* may be vertically offset from the first major surface 201*a* of the sound attenuation layer 200*a* by the attenuation coating 300*a*. Specifically, the second major surface 102*a* of the first air-permeable body 100*a* may be vertically offset from the first major surface 201*a* of the sound attenuation layer 200*a* by the top attenuation coating 310*a*.

According to this embodiment, the acoustic building panel 20*a* is formed from the combination of the coated body 80*a* and the attenuation body 200*a*. In particular, the first major exposed surface 21*a* of the acoustic building panel 20*a* may comprise the first major surface 81*a* of the coated body 80*a*—i.e., the first major exposed surface 21*a* may comprise the first major surface 101*a* of the air-permeable layer 100*a*. According to such embodiments, the second major exposed surface 22*a* may comprise the second major surface 202*a* of the sound attenuation layer 200*a*. According to such embodiments, the side exposed surface 23*a* may comprise both the side surface 83*a* of the coated body 80*a* and the side surface 203*a* of the sound attenuation layer 200*a*—i.e., the side exposed surface 23*a* may comprise the outer surface 321*a* of the side attenuation coating 320*a* and the side surface 203*a* of the sound attenuation layer 200*a*.

Figure 9:
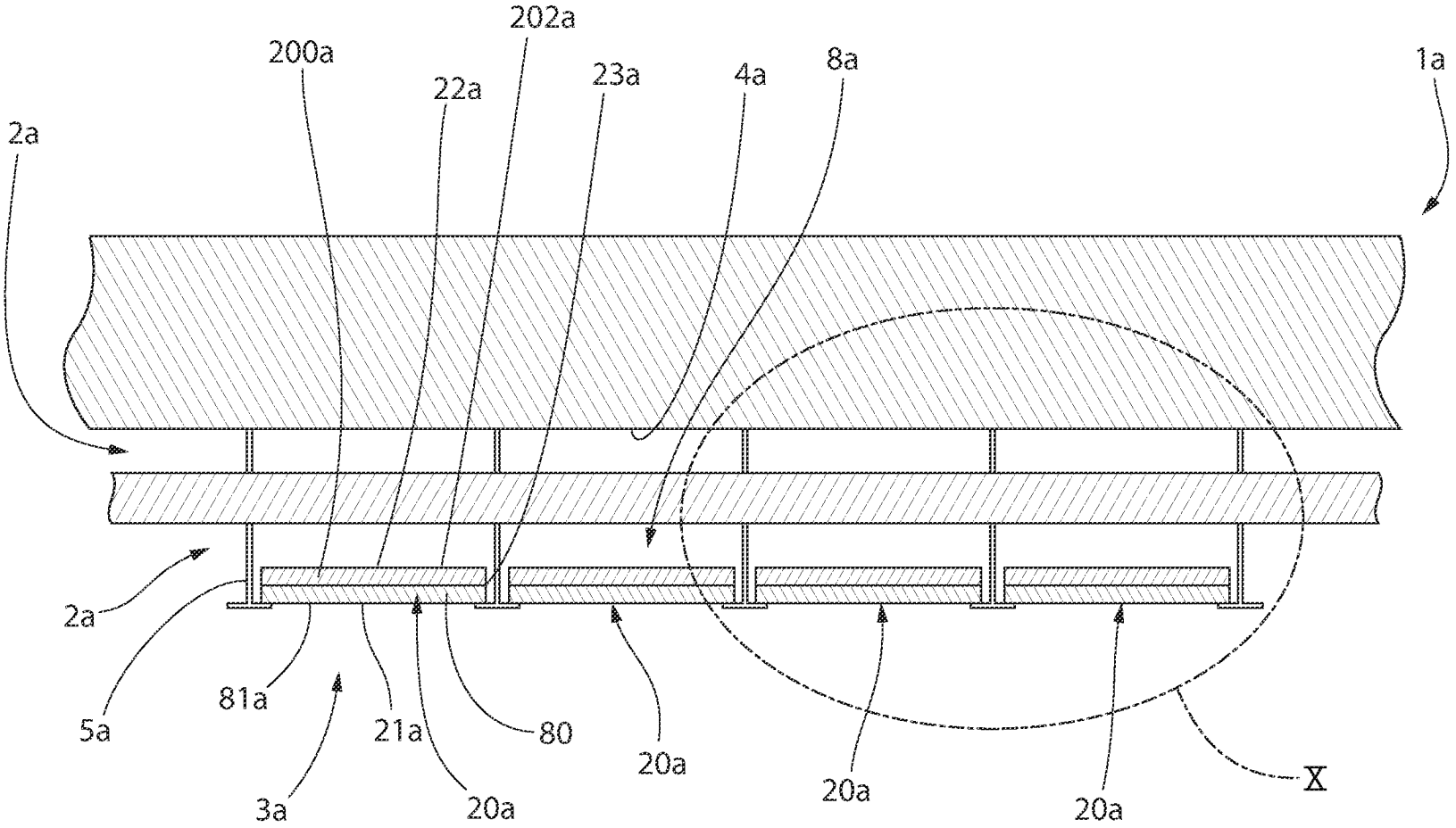
FIG. 9 is a side view of building system comprising a plurality of the acoustic building panels of FIG. 6 according to the present invention.
Figure 10:
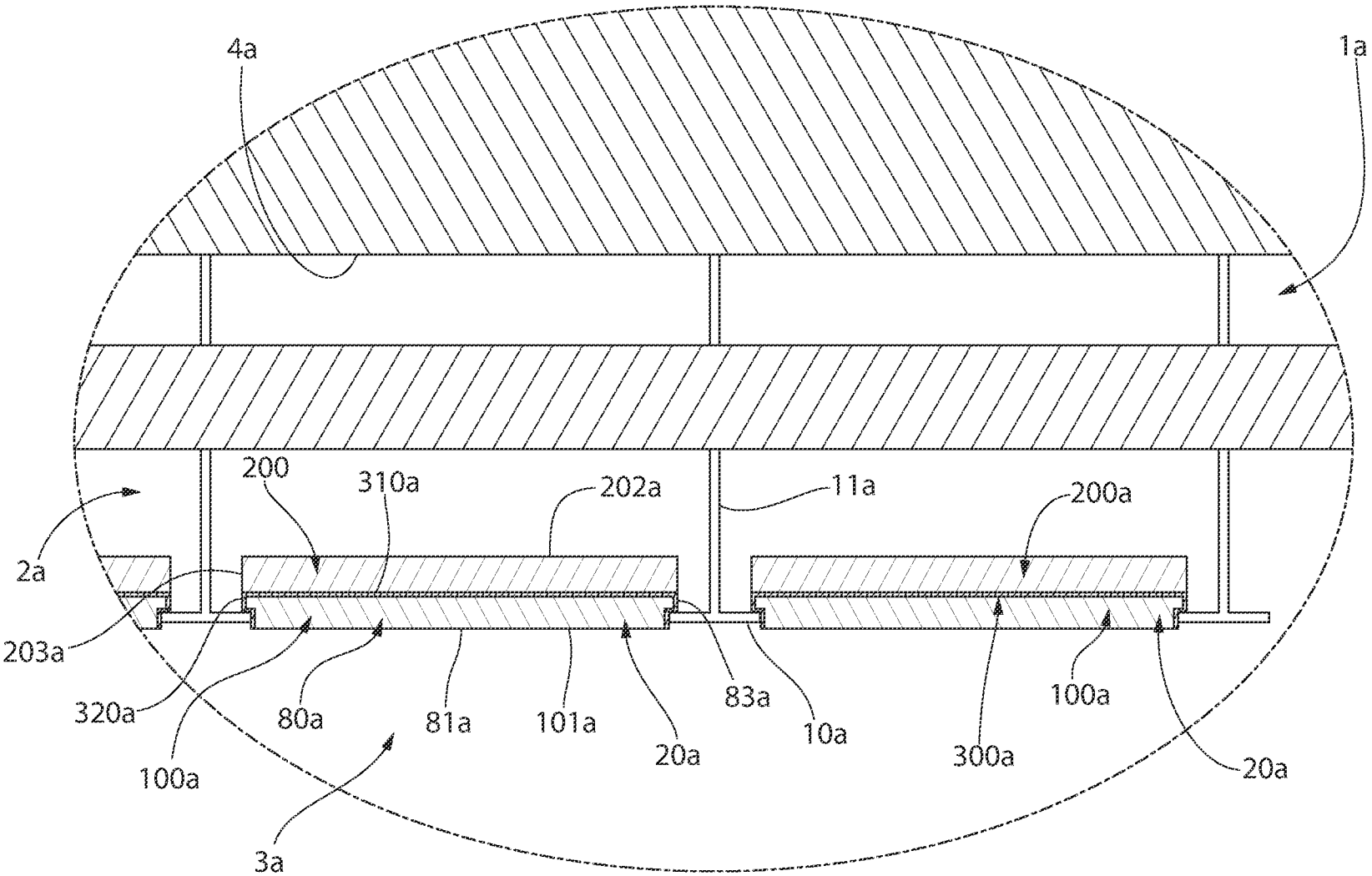
FIG. 10 is a close-up cross-sectional view of region X of the building system of FIG. 6.
Figure 11:
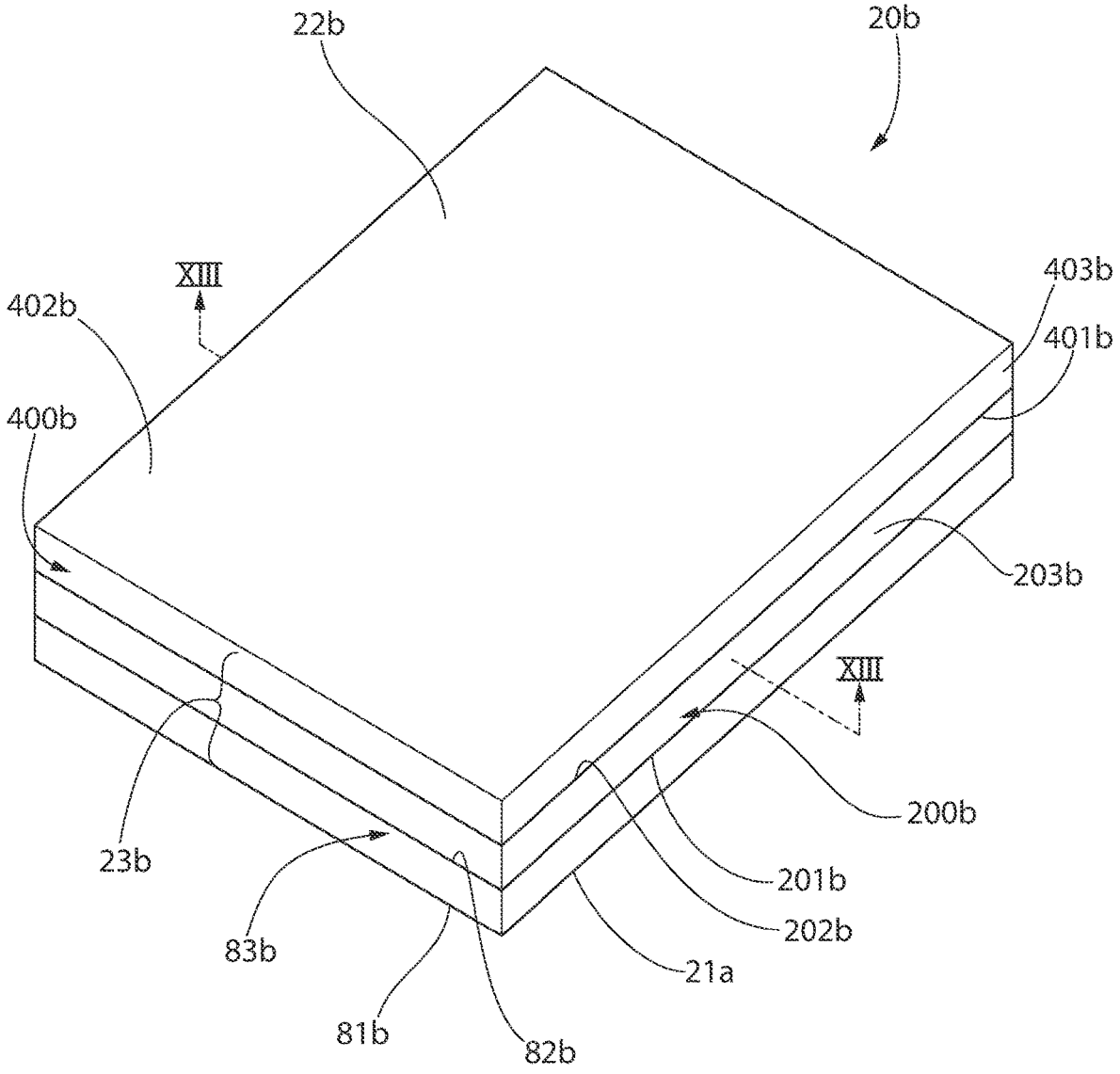
FIG. 11 is a perspective view of an acoustic building panel according to another embodiment of the present invention.
Figure 12:
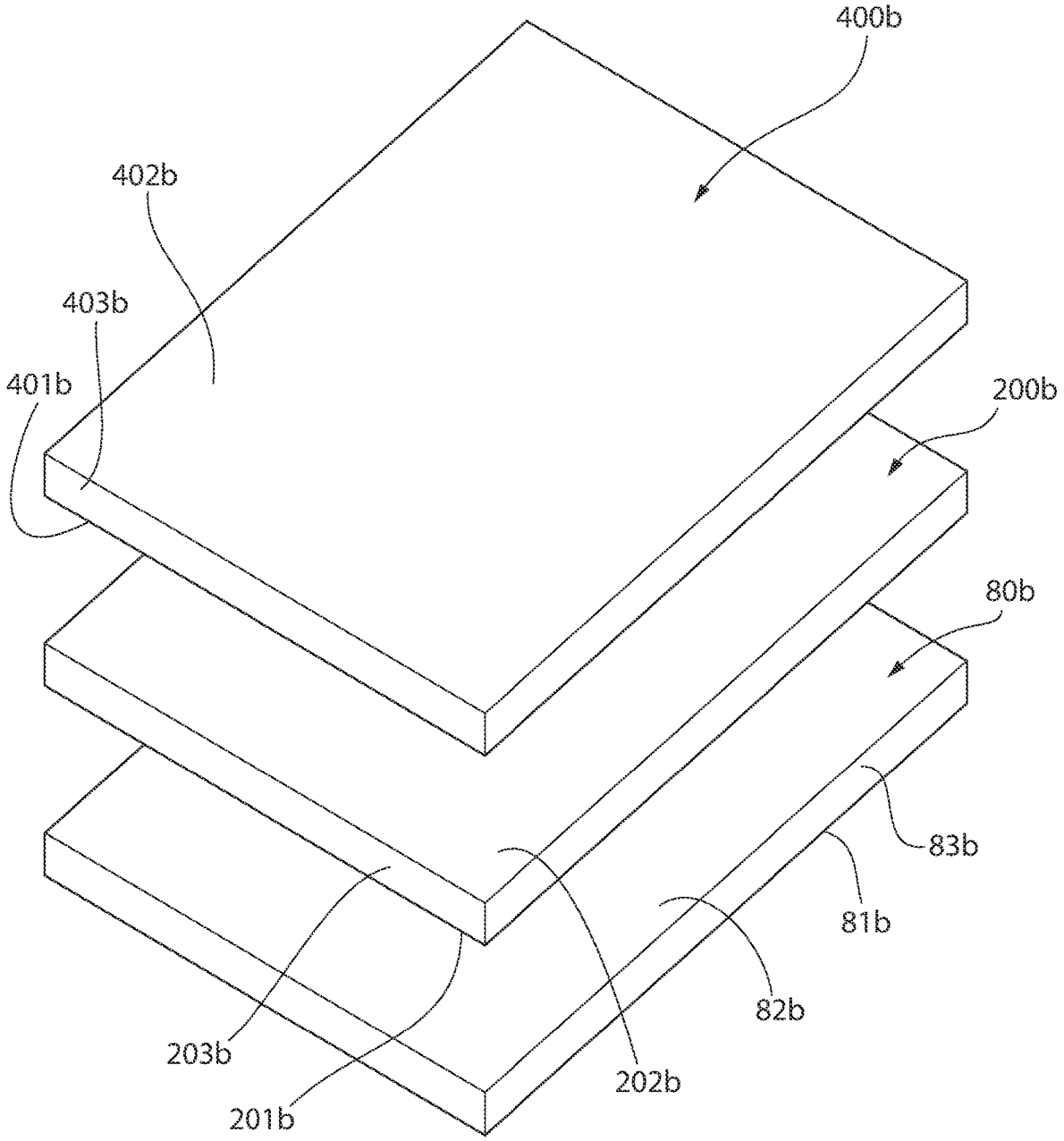
FIG. 12 is an exploded perspective view of the acoustic building panel of FIG. 11.
Figure 13:
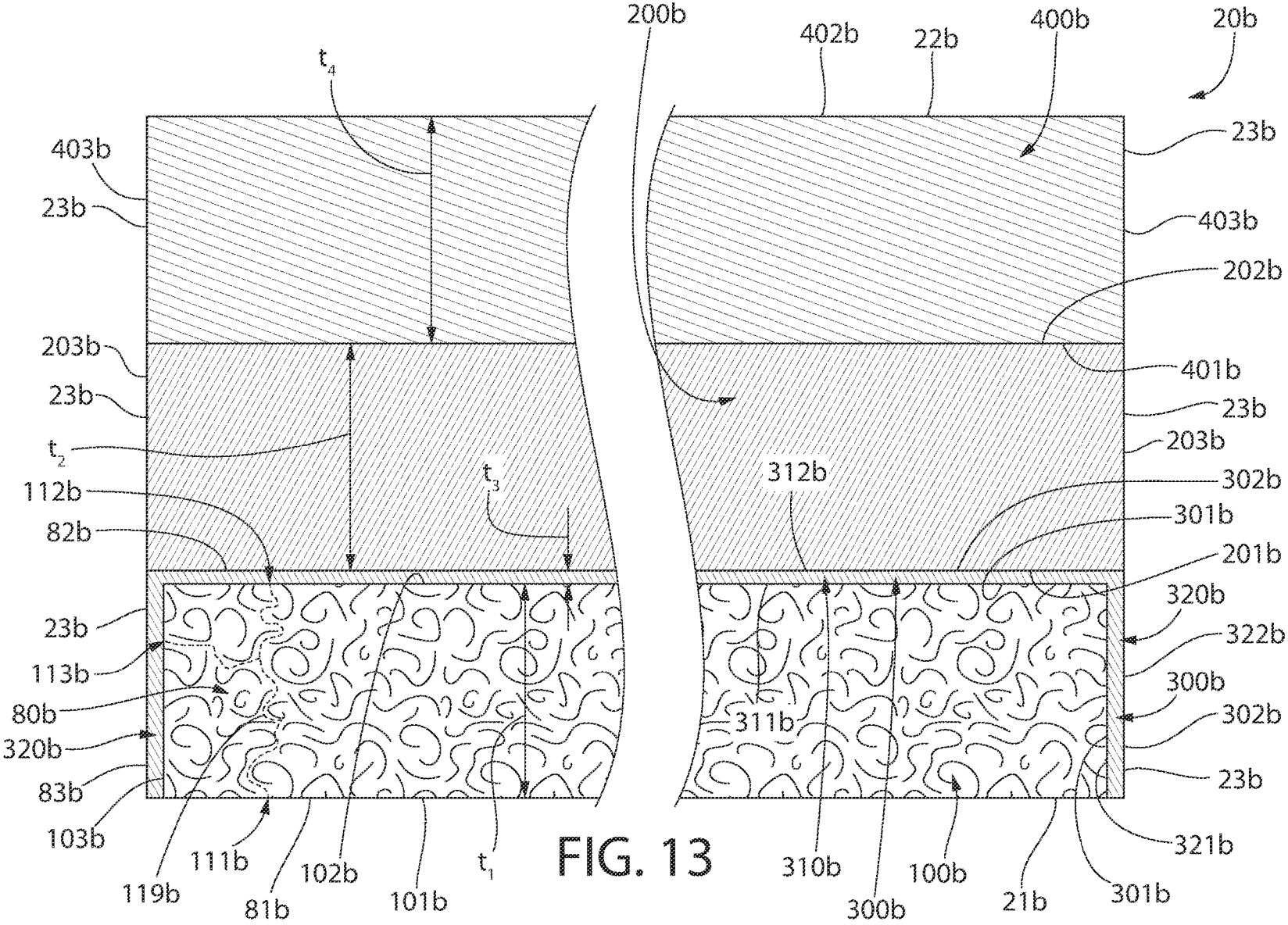
FIG. 13 is a cross-sectional view of the acoustic building panel along line XIII-XIII of FIG. 11.

Referring now to FIGS. 9 and 10, the acoustic building panel 20*a* of this embodiment may be positioned within a ceiling system 1*a* such that the first major surface 21*a* of the acoustic building panel 20*a* faces the active room environment 3*a* and the second major surface 22*a* faces the plenary space 2*a*. Specifically, the acoustic building panel 20*a* of this embodiment may be positioned within a ceiling system 1*a* such that the first major surface 101*a* of the first air-permeable body 100*a* faces the active room environment 3*a* and second major surface 202*a* of the sound attenuation body 200*a* faces the plenary space 2*a*. Additionally, according to this embodiment, the acoustic building panel 20*a* of this embodiment may be positioned within a ceiling system 1*a* such that the side surface 203*a* of the sound attenuation body 200*a* faces the plenary space 2*a*.

The acoustic building panel 20*a* of this embodiment may be positioned within a ceiling system 1*a* such that the first major surface 101*a* of the first air-permeable body 100*a* faces the active room environment 3*a* and outer surface 322*a* of the side attenuation coating 320*a* faces a portion of both the plenary space 2*a* and the active room environment 3*a*. In other embodiments, the acoustic building panel 20*a* of this embodiment may be positioned within a ceiling system 1*a* such that the first major surface 101*a* of the first air-permeable body 100*a* faces the active room environment 3*a* and the entire outer surface 322*a* of the side attenuation coating 320*a* faces the plenary space 2*a*.

The acoustic building panel 20*a* according to this embodiment, when installed in a ceiling system, may result in a ceiling system 1*a* that exhibits a CAC value greater than 40 dB, preferably greater than 45 dB—including all values and sub-ranges there-between. In a non-limiting embodiment, the acoustic building panel 20*a*, when installing in a ceiling system, may result in a ceiling system 1*a* exhibiting a CAC value ranging from 40 dB to about/dB—including all CAC values and sub-ranges there-between. Additionally, according to this embodiment, the acoustic building panel 20*a* may exhibit an NRC value of at least 0.75. In a non-limiting embodiment, the acoustic building panel 20*a* may exhibit an NRC value ranging from 0.5 to about 0.9—including all NRC values and sub-ranges there-between.

Referring now to FIGS. 11-15, an acoustic building panel 20*b* is illustrated in accordance with another embodiment of the present invention. The acoustic building panel 20*b* is similar to the acoustic building panels 20, 20*a* except as described herein below. The description of the acoustic building panels 20, 20*a* above generally applies to the acoustic building panel 20*b* described below except with regard to the differences specifically noted below. A similar numbering scheme will be used for the acoustic building panel 20*b* as with the acoustic building panels 20, 20*a* except that the numbers having the suffix "b" will be used.

According to this embodiment, the acoustic building panel 20*b* may further comprise a third layer 400*b* that functions as a noise-reduction layer but imparts additional sound attenuation properties to the overall acoustic building panel 20*b*. The third layer 400*b* may be referred to as a "second air-permeable body." The second air-permeable body 400*b* may comprise a first major surface 401*b* (also referred to a "lower major surface") that is opposite a second major surface 402*b* (also referred to as an "upper major surface") as well as side surfaces 403*b* that extends between the first and second major surfaces 401*b*, 402*b* of second air-permeable body 400*b*. The second air-permeable body 400*b* may have an overall length and width. The length of the second air-permeable body 400*b* may be substantially equal to the length of the acoustic building panel 20*b*. The width of the second air-permeable body 400*b* may be substantially equal to the width of the acoustic building panel 20*b*.

The second air-permeable body 400*b* may have a fourth thickness $t_4$ as measured by the distance between the first and second major surfaces 401*b*, 402*b* of the second air-permeable body 400*b*. The fourth thickness $t_3$ may range from about 0.25 inches to about 3.0 inches—including all thickness and sub-ranges there-between.

In some embodiments the second air-permeable body 400*b* may be formed from one or more aforementioned materials listed as suitable for the first air-permeable body 100*b*. In some embodiments, the second air-permeable body

400*b* predominantly provides a noise-reduction characteristic that in its unique position surprisingly provides sound attenuation function to the overall acoustic building panel 20*b*. Therefore, the preferred materials for providing the sound attenuation function of this third layer 400*b* may actually be typically selected for noise reduction, not as expected for sound attenuation. In some embodiments the second air-permeable body 400*b* is produced from mineral fiber, fiberglass, polyester, or natural fibers.

The second air-permeable body 400*b* may have a third density ranging from about 2 lb/ft$^3$ to about 16 lb/ft$^3$—including all densities and sub-ranges there-between. In a preferred, embodiment the second air-permeable body 400*b* may have a third density ranging from about 3.5 lb/ft$^3$ to about 14 lb/ft$^3$—including all densities and sub-ranges there-between. A ratio of the third density of the second air-permeable body 400*b* to the first density of the first air-permeably body 100 may range from about 1:0.8 to about 0.8:1—including all ratios and sub-ranges there-between. A ratio of the second density of the sound attenuation body 200*b* to the third density of the second air-permeable body 400*b* may range from about 1.5:1 to about 10:1—including all densities and sub-ranges there-between. In a preferred embodiment, the ratio of the second density to the third density may be at least 2:1, preferably 3:1. In some embodiments, the ratio of the second density to the third density may be about 4:1.

The acoustic building panel 20*b* of this embodiment may be formed by positioning the second air-permeable body 400*b* atop the sound attenuation body 200*b* (which is atop the coated body 80*a*). Specifically, the first major surface 401*b* of the second air-permeable body 400*b* may be placed in contact with the second major surface 202*a* of the sound attenuation body 200*b*. In some embodiments, adhesive may be applied between the first major surface 401*b* of the second air-permeable body 400*b* and the second major surface 202*b* of the sound attenuation body 200*b*, thereby adhesively bonding together the second air-permeable body 400*b* and the sound attenuation layer 200*b*. In other embodiments, the first major surface 401*b* of the second air-permeable body 400*b* may be free-floating contact with the second major surface 202*b* of the sound attenuation layer 200*b*. In other embodiments, the sound attenuation body 400*b* may be coupled to the sound attenuation layer 200*b* by mechanical fastener.

Therefore, the acoustic building panel 20*b* of this embodiment may comprise the sound attenuation body 200*b* sandwiched between the second air-permeable body 400*b* and the coated body 80*b*. Specifically, the first major surface 201*b* of the sound attenuation layer 200*b* may face the second major surface 82*b* of the coated body 80*b* and the second major surface 202*b* of the sound attenuation layer 200*b* may face the first major surface 401*b* of the second air-permeable body 400*b*.

According to this embodiment, the acoustic building panel 20*b* is formed from the combination of the coated body 80*b*, the attenuation body 200*b*, and second air-permeable body 400*b*. In particular, the first major exposed surface 21*b* of the acoustic building panel 20*b* may comprise the first major surface 81*b* of the coated body 80*b*—i.e., the first major exposed surface 21*b* may comprise the first major surface 101*b* of the air-permeable layer 100*b*. According to such embodiments, the second major exposed surface 22*b* may comprise the second major surface 402*b* of the second air-permeable body 400*b*. According to such embodiments, the side exposed surface 23*b* may comprise the side surface 83*b* of the coated body 80*b*, the side surface 203*b* of the sound attenuation layer 200*b*, and the side surface 403*b* of the second air-permeable body 400*b*—i.e., the side exposed surface 23*b* may comprise the outer surface 321*b* of the side attenuation coating 320*b*, the side surface 203*b* of the sound attenuation layer 200*b*, and the side surface 403*b* of the second air-permeable body 400*b*.

Figure 14:
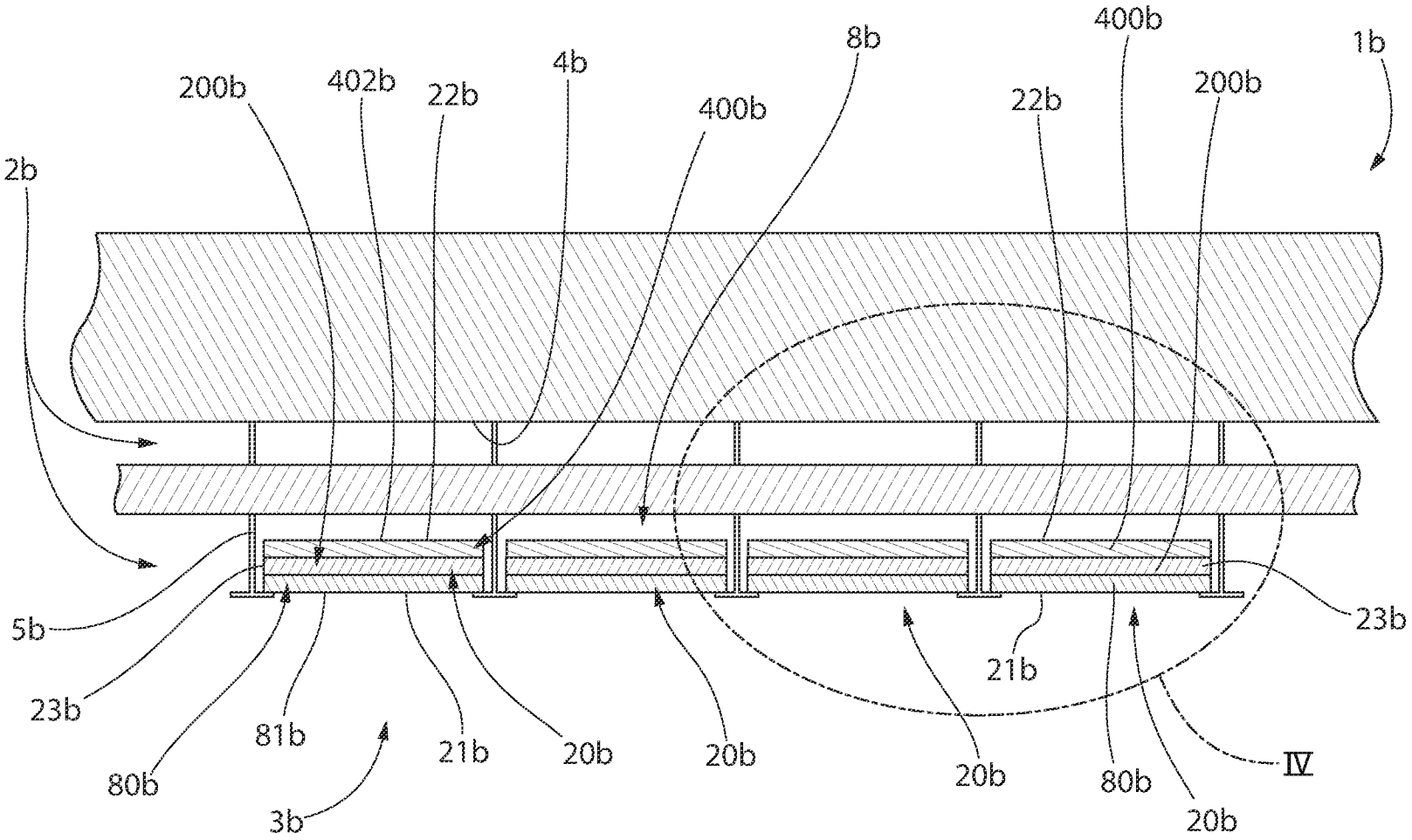
FIG. 14 is a side view of building system comprising a plurality of the acoustic building panels of FIG. 11 according to the present invention.
Figure 15:
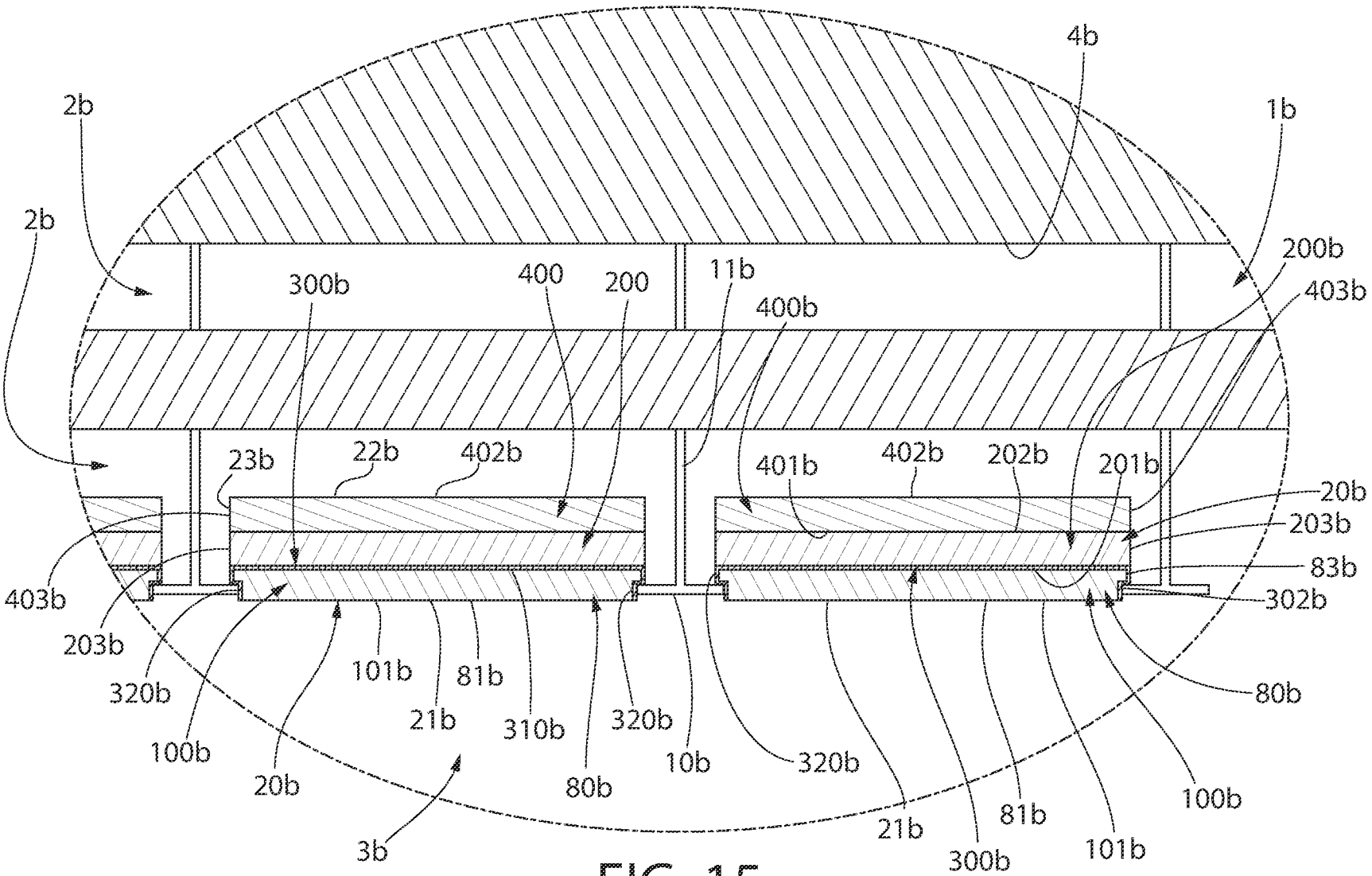
FIG. 15 is a close-up cross-sectional view of region IV of the building system of FIG. 11.

Referring now to FIGS. 14 and 15, the acoustic building panel 20*b* of this embodiment may be positioned within a ceiling system 1*b* such that the first major surface 21*b* of the acoustic building panel 20*b* faces the active room environment 3*b* and the second major surface 22*b* faces the plenary space 2*b*. Specifically, the acoustic building panel 20*b* of this embodiment may be positioned within a ceiling system 1*b* such that the first major surface 101*b* of the first air-permeable body 100*b* faces the active room environment 3*b* and second major surface 402*b* of the second air-permeable body 400*b* faces the plenary space 2*b*. Additionally, according to this embodiment, the acoustic building panel 20*b* of this embodiment may be positioned within a ceiling system 1*b* such that the side surface 203*b* of the sound attenuation body 200*b* and the side surface 403*b* of the second air-permeable body 400*b* face the plenary space 2*b*.

Ceiling systems 1*b* produced using acoustic building panel 20*b* according to this embodiment may exhibit a CAC value greater than 50 dB, preferably greater than 55 dB. In a non-limiting embodiment, the acoustic building panel 20*b* may exhibit a CAC value ranging from 50 dB to about 60 dB—including all CAC values and sub-ranges there-between. Additionally, according to this embodiment, the acoustic building panel 20*b* may exhibit an NRC value of at least 0.75. In a non-limiting embodiment, the acoustic building panel 20*b* may exhibit an NRC value ranging from 0.5 to about 0.9—including all NRC values and sub-ranges there-between.

The invention will be described in greater detail by way of specific examples. The following examples are offered for illustrative purposes and are not intended to limit the invention in any manner.

EXAMPLES

Experiment 1—Back and Side Seal-Coating

The following examples were prepared to test and measured the enhanced sound attenuation performance as well as the retained noise reduction performance of the acoustic building panels of the present invention when the attenuation coating is applied to a noise reducing layer. Experiment 1 utilizes an attenuation coating comprising 3 to 15 wt. % of polymeric binder (starch or latex polymer), 85 to 96 wt. % of filler (clay or calcium carbonate), as well as suitable amounts of viscosity modifying agents, defoamers, and biocides. Experiment 1 further utilizes an air-permeable body having a first major surface opposite a second major surface and a side surface extending between the first and second major surfaces, whereby the boy is formed from mineral fiber and has an NRC value of 0.85 and a CAC value of 35.

First and second test samples (i.e., Comparative Examples 1 and 2) were each prepared by applying an attenuation coating to the second major surface of the air-permeable body. Specifically, a first primer layer of the attenuation coating was applied in an amount of 18 g/ft$^2$ (in the wet-state) and allowed to dry. Subsequently, a second application of the attenuation coating was roll-coated onto the dried prime coat in an amount of about 26 g/ft$^2$ (in the wet state) and allowed to dry. Subsequently another application of the attenuation coating roll-coated onto the dried second application of attenuation coating in an amount of about 23 g/ft$^2$ (in the wet-state). The combination of the prime coat and the two subsequent coatings sealed substantially all openings present on the second major surface of the air-permeable body. Adhesive was then applied to the first major surface of the air-permeable bodies and a non-woven scrim was attached thereto. A paint was applied to the exposed surface of the non-woven scrim in an amount of 14.7 g/ft$^2$ in a wet-state at about 50% solids. The first exposed major surface of the building panel comprising the painted scrim still comprises openings that allowed for air to flow into the air-permeably body under atmospheric conditions. Additionally, to be clear, the side surfaces of the air-permeable body remained uncoated. The NRC and CAC value of each coated body was then measured and recorded.

A third test sample (i.e., Example 1) was prepared by applying an attenuation coating to the second major surface of the air-permeable body. Specifically, a first primer layer of the attenuation coating was applied in an amount of 18 g/ft$^2$ (in the wet-state) and allowed to dry. Subsequently, a second application of the attenuation coating was roll-coated onto the dried primer layer in an amount of about 30 g/ft$^2$ (in the wet state) and allowed to dry. Subsequently another application of the attenuation coating was roll-coated onto the dried second application of attenuation coating in an amount of about 23 g/ft$^2$ (in the wet-state). The combination of the prime coat and the two subsequent roll-coatings sealed substantially all openings present on the second major surface of the air-permeable body. The side surfaces were then coated with an attenuation coating by a vacuum edge coating process, which sealed substantially all openings present on the side surface of the air-permeable body. Adhesive was then applied to the first major surface of the air-permeable bodies and a non-woven scrim was attached thereto. A paint was applied to the exposed surface of the non-woven scrim in an amount of 14.7 g/ft$^2$ in a wet-state at about 50% solids. The first exposed major surface of the building panel comprising the painted scrim still comprises openings that allowed for air to flow into the air-permeably body under atmospheric conditions. The NRC and CAC value of each coated body was then measured and recorded.

The NRC and CAC values of Comparative Examples 1 and 2, as well as Examples 1 and 2, are set forth below in Table 1.

TABLE 1

| | Comp. Ex. 1 | Comp. Ex. 2 | Ex. 1 |
|---|---|---|---|
| NRC | 0.85 | 0.85 | 0.85 |
| CAC | 35 | 34 | 38 |

As demonstrated by Table 1, the application of an attenuation coating to the side surface of the air-permeable body not only improved the CAC performance by almost 10%, but it also avoided negatively impacting the NRC performance of the air-permeable body even though substantially all of the openings present on the second major surface and the side surface were sealed. Additionally, failure to apply the attenuation coating to the side surface of the air-permeably body actually worsened CAC performance, as demonstrated by Comparative Example 2. Therefore, it has been surprisingly discovered that the application of attenuation coating to the rear and side surfaces of a noise-reduction panel allows for desirable NRC performance to be maintained while also improving CAC performance.

Experiment 2—Backer Attenuation Layer

The following examples were prepared to test and measured the enhanced sound attenuation performance as well as the retained noise reduction performance of the acoustic building panels of the present invention when an attenuation layer is applied atop the coated air-permeable body. Experiment 2 utilizes the same air-permeable body and attenuation coating as used in Experiment 1 except for the differences provided herein.

A first test sample (i.e., Example 2) was prepared by applying an attenuation coating to the second major surface of the air-permeable body. Specifically, a first primer layer of the attenuation coating was applied in an amount of 18 g/ft$^2$ (in the wet-state) and allowed to dry. Subsequently, a second application of the attenuation coating was roll-coated onto the dried primer layer in an amount of about 26 g/ft$^2$ (in the wet state) and allowed to dry. Subsequently another application of the attenuation coating roll-coated onto the dried first application of attenuation coating in an amount of about 23 g/ft$^2$ (in the wet-state). The combination of the primer layer and the subsequent roll-coatings sealed substantially all openings present on the second major surface of the air-permeable body. Adhesive was then applied to the first major surface of the air-permeable bodies and a non-woven scrim was attached thereto. A paint was applied to the exposed surface of the non-woven scrim in an amount of 14.7 g/ft$^2$ in a wet-state at about 50% solids. The first exposed major surface of the building panel comprising the painted scrim still comprises openings that allowed for air to flow into the air-permeably body under atmospheric conditions. Additionally, to be clear, the side surfaces of the air-permeable body remained uncoated. The resulting coated air-permeably body yielded a CAC value of 40.

An attenuation layer was provided, the attenuation layer comprising gypsum board and having a first major surface opposite a second major surface and side surfaces extending between the first and second major surfaces. The attenuation layer was laid loosely atop the dried attenuation coating present on the second major surface of the air-permeable body to form a multilayered structure. Specifically, the first major surface of the attenuation layer was positioned in contact with the upper surface of the coated air-permeable body (i.e., the first major surface of the air-permeable body). The NRC and CAC values of the multilayered structure were then measured, and the values are set forth below in Table 2.

TABLE 2

| | No Gypsum Backer Board | Ex. 2 |
|---|---|---|
| NRC | 0.8 | 0.8 |
| CAC | 40 | 48 |

As demonstrated by Table 2, even though the openings present on the second major surface and the side surface have already been sealed by the attenuation coating, the application of an attenuation layer to the second major surface of the coated air-permeable body surprisingly provides a marked further improvement in CAC performance by 20% without any degradation to the noise reduction performance of the coated air-permeable body. Therefore, it has been surprisingly discovered that adding an attenuation layer atop an already sealed second major surface of a coated noise reducing panel allows for further improved sound attenuation performance without any interference with the NRC value of the coated air-permeable panel.

Experiment 3—Fiberglass Backer Layer

The following example (Example 3) was prepared to test and measured the enhanced sound attenuation performance as well as the retained noise reduction performance of the acoustic building panels of the present invention when a noise reduction layer is applied atop a multi-layered structure comprising an attenuation layer applied atop the coated air-permeable body. Experiment 3 utilizes the same multi-layered acoustic panel of Experiment 2 except for the differences provided herein.

Starting with the multi-layered acoustic panel of Experiment 2, a second air-permeable body was positioned atop the coated air-permeably body. Specifically, the second air-permeable body comprises fiberglass and has a first major surface opposite a second major surface and a side surface extending between the first and second major surfaces. The first major surface of the second air-permeably body contacts the second major surface of the attenuation layer to form another multi-layered acoustic panel. The second air-permeable body comprises openings that allowed for air to flow into the second air-permeable body under atmospheric conditions. The NRC and CAC values of the multilayered structure were then measured, and the values are set forth below in Table 3.

TABLE 3

| | No Second Air-Permeable Body | Ex. 3 |
|---|---|---|
| NRC | 0.8 | 0.8 |
| CAC | 48 | 53 |

As demonstrated by Table 3, the addition of a second air-permeable layer facing the plenum space surprisingly results in a CAC value of over 50.

As those skilled in the art will appreciate, numerous changes and modifications may be made to the embodiments described herein, without departing from the spirit of the invention. It is intended that all such variations fall within the scope of the invention.

The invention claimed is:

1. A ceiling system comprising:

a ceiling grid comprising a plurality of first members and a plurality of second members, the first and second members intersecting one another to define a plurality of grid openings;

a plenary space above the ceiling grid;

a room environment below the ceiling grid; and an acoustical ceiling panel comprising a first exposed major surface opposite a second exposed major surface and an exposed side surface extending between the first and second exposed major surfaces, the acoustical ceiling panel mounted to the ceiling grid and positioned within the grid opening, the acoustic ceiling panel comprising:

a first air-permeable body comprising a first major surface opposite a second major surface and a side surface extending between the first and second major surfaces, the first air-permeable body having an NRC value of at least 0.5 as measured between the first and second major surfaces of the first air-permeable body; and an attenuation coating applied to the second major surface of the first air-permeable body and the side surface of the first air-permeable body, whereby the attenuation coating seals at least a portion of the second major surface and the side surface of the first air-permeable body; and wherein the first major surface of the first air-permeable body faces the room environment; and wherein the first exposed major surface of the acoustical ceiling panel comprises the entirety of the first major surface of the first air-permeable body.

2. The ceiling system according to claim 1, wherein the first major surface of the first air-permeable body is fully exposed on the first exposed major surface of the acoustical ceiling panel.

3. The acoustic ceiling panel according to claim 1, wherein the attenuation coating extends continuously from the second major surface of the first air-permeable body to the side surface of the first air-permeable body.

4. The acoustic ceiling panel according to claim 1, wherein the first air-permeable body is formed from a fibrous material.

5. The acoustic ceiling panel according to claim 1, wherein the acoustic ceiling panel further comprises an attenuation body comprising a first major surface opposite a second major surface and a side surface extending between the first and second major surfaces of the attenuation body, the attenuation body having a CAC value of at least 40 as measured between the first and second major surfaces of the attenuation body.

6. The acoustic ceiling panel according to claim 5, wherein the attenuation body is positioned within the acoustic ceiling panel such that attenuation coating is sandwiched between the first body and the attenuation body.

7. The acoustic ceiling panel according to claim 5, wherein the attenuation body is formed from a material consisting of gypsum, cement board, granite, ceramic board and combinations thereof.

8. The acoustic ceiling panel according to claim 5, wherein the first major surface of the attenuation body is adhesively bonded to the attenuation coating, and wherein the first major surface of the attenuation body faces the second major surface of the first body and the second exposed major surface of the acoustic ceiling panel comprises the second major surface of the attenuation body.

9. The acoustic ceiling panel according to claim 5, wherein the acoustic ceiling panel further comprises a second air-permeable body comprising a first major surface opposite a second major surface and a side surface extending between the first and second major surfaces, the second air-permeable body having an NRC value of at least 0.5 as measured between the first and second major surfaces of the second air-permeable body.

10. The acoustic ceiling panel according to claim 9, wherein the second exposed major surface of the acoustic ceiling panel comprises the second major surface of the second air-permeable body.

11. A ceiling system comprising:

a ceiling grid comprising a plurality of grid openings;

a plenary space above the ceiling grid;

a room environment below the ceiling grid; and an acoustical ceiling panel mounted to the ceiling grid and positioned within the grid opening, the acoustic ceiling panel comprising:

a first air-permeable body comprising a first major surface opposite a second major surface and a side surface extending between the first and second major surfaces of the first body, the first major surface comprises a first plurality of openings, the second major surface comprising a second plurality of openings, and the side surface comprising a third plurality of openings, and the first air-permeable body having an NRC value of at least 0.75 as measured between the first and second major surfaces of the first air-permeable body;

an attenuation coating applied to the second major surface of the first air-permeable body and the side surface of the first air-permeable body; and an attenuation body comprising a first major surface opposite a second major surface and a side surface extending between the first and second major surfaces of the attenuation body, the attenuation body having a CAC value of at least 40 as measured between the first and second major surfaces of the attenuation body;

whereby the attenuation coating is positioned between the first air-permeable body and the attenuation body, and the first major surface of the attenuation body is offset from the second major surface of the first air-permeable body by the attenuation coating; and wherein the first major surface of the first air-permeable body faces the room environment.

12. The ceiling system according to claim 11, wherein the acoustical ceiling panel comprises a first exposed major surface opposite a second exposed major surface, and wherein the first exposed major surface of the acoustical ceiling panel is substantially free of the attenuation coating.

13. The ceiling system according to claim 12, wherein the second exposed major surface comprises the attenuation coating.

14. The acoustic ceiling panel according to claim 11, wherein the attenuation coating is applied to the second major surface of the first air-permeable body in an amount ranging from about 10 g/ft$^2$ to about 45 g/ft$^2$.

15. The acoustic ceiling panel according to claim 11, wherein the attenuation coating is applied to the side surface of the first air-permeable body in an amount ranging from about 4 g/linear foot to about 8 g/linear foot.

16. The acoustic ceiling panel according to claim 11, wherein the first air-permeable body is formed from a fibrous material selected from organic fiber, inorganic fiber, and combinations thereof.

17. The acoustic ceiling panel according to claim 11, wherein the attenuation body is formed from a material consisting of gypsum, cement board, granite, ceramic board.

18. A ceiling system comprising:

a plurality of struts configured to be assembled into a ceiling grid comprising a plurality of grid openings, the ceiling grid configured to be mounted within a building so that a plenary space exists above the ceiling grid and a room environment exists below the ceiling grid; and an acoustical ceiling panel configured to be mounted to the ceiling grid and positioned within the grid opening so that a first exposed major surface of the acoustical ceiling panel faces the room environment and a second exposed major surface of the acoustic ceiling panel faces the plenary space, the acoustic ceiling panel comprising:

the first exposed major surface being opposite the second major exposed surface and a side exposed surface extending between the first and second major exposed surfaces;

a multilayered body having comprising:

a first layer formed of noise reducing air-permeable material, the first layer comprising a first major surface opposite a second major surface and a side surface extending between the first major surface and the second major surface;

a second layer of sound attenuation material; and an attenuation coating between the first layer and the second layer;

wherein the first exposed major surface comprises the entirety of the first major surface of the first layer, the first major surface formed of the noise reducing air-permeable material; and wherein the second exposed major surface comprises the sound attenuation material of the second layer, and the exposed side surface comprises the first layer, the second layer, and the attenuation coating.

19. The ceiling system according to claim 18, wherein the first major surface of the first layer is fully exposed on the first exposed major surface of the acoustic ceiling panel.

20. The ceiling system according to claim 18, wherein the sound attenuation material is selected from gypsum, cement board, granite, ceramic board.

21. The ceiling system according to claim 18, wherein the attenuation coating forms a substantially continuous barrier between the first layer and the second layer.

* * * * *